US010161602B1

(12) United States Patent
Bleile

(10) Patent No.: US 10,161,602 B1
(45) Date of Patent: Dec. 25, 2018

(54) ILLUMINATING DEVICE

(71) Applicant: Stephen P. Bleile, Sarasota, FL (US)

(72) Inventor: Stephen P. Bleile, Sarasota, FL (US)

( * ) Notice: Subject to any disclaimer, the term of this patent is extended or adjusted under 35 U.S.C. 154(b) by 0 days.

(21) Appl. No.: 15/673,586

(22) Filed: Aug. 10, 2017

Related U.S. Application Data

(60) Provisional application No. 62/373,735, filed on Aug. 11, 2016.

(51) Int. Cl.

| | |
|---|---|
| ***F21V 17/02*** | (2006.01) |
| ***F21S 9/02*** | (2006.01) |
| ***F21V 23/04*** | (2006.01) |
| ***F21V 21/08*** | (2006.01) |
| ***F21V 17/16*** | (2006.01) |
| ***F21V 21/22*** | (2006.01) |

(52) U.S. Cl.
CPC ..... *F21V 17/02* (2013.01); *F21S 9/02* (2013.01); *F21V 17/166* (2013.01); *F21V 21/08* (2013.01); *F21V 21/22* (2013.01); *F21V 23/045* (2013.01)

(58) Field of Classification Search
CPC ..... F21V 17/02; F21V 17/166; F21V 21/08; F21V 21/22; F21V 23/045; F21S 9/02
USPC ..... 362/249.06, 249.07, 249.08, 249.09, 362/249.11, 249.12, 249.14, 249.16, 396, 362/809, 808, 806, 216
See application file for complete search history.

(56) References Cited

U.S. PATENT DOCUMENTS

| | | | | |
|---|---|---|---|---|
| 5,629,057 | A | 5/1997 | Wang et al. | |
| 5,645,343 | A | 7/1997 | Rinehimer | |
| 5,776,578 | A | 7/1998 | Dejaynes | |
| 5,876,111 | A | 3/1999 | Jeng-Shyong | |
| 5,893,636 | A | 4/1999 | Babineaux | |
| 6,070,991 | A | 6/2000 | Rumpel | |
| 6,305,827 | B1 * | 10/2001 | Nolle | F21L 14/00 362/189 |
| 6,401,404 | B1 | 6/2002 | Fillipp et al. | |
| 6,419,373 | B1 * | 7/2002 | Shieh | A45B 3/04 135/16 |
| 6,474,843 | B2 | 11/2002 | Shieh | |
| 6,769,793 | B2 | 8/2004 | Hornsby et al. | |
| 8,764,234 | B1 | 7/2014 | Acree et al. | |
| 2010/0097812 | A1 * | 4/2010 | Cheng | F21V 21/14 362/382 |
| 2014/0153243 | A1 * | 6/2014 | Braasch | F21S 9/02 362/249.02 |
| 2016/0178172 | A1 * | 6/2016 | Boyink | F21V 23/003 362/123 |

* cited by examiner

*Primary Examiner* — Laura Tso

(74) *Attorney, Agent, or Firm* — Frijouf, Rust & Pyle, P.A.

(57) ABSTRACT

An illuminating device is disclosed including a lower base having a plurality of lower pivot receivers. An upper base has a plurality of upper pivot receivers. A plurality of rods are pivotably coupled to the lower base and the upper base. The plurality of rods convert between a general linear configuration and a general arcuate configuration upon converging the lower base with the upper base. The first rod and the second rod convert between the general arcuate configuration and the general linear configuration upon diverging the lower base with the upper base. A lock extends between the lower base and the upper base for terminating displacement of the lower base relative to the upper base. A plurality of illuminating devices are coupled to the plurality of rods.

14 Claims, 25 Drawing Sheets

ILLUMINATING DEVICE

CROSS-REFERENCE TO RELATED APPLICATIONS

This application claims benefit of U.S. Patent Provisional application No. 62/373,735 filed Aug. 11, 2016. All subject matter set forth in provisional application Ser. No. 62/373,735 is hereby incorporated by reference into the present application as if fully set forth herein.

BACKGROUND OF THE INVENTION

Field of the Invention

This invention relates to illumination and more particularly to an illuminating device.

Background of the Invention

Illuminating devices may be utilized for illuminating purposes, decorative purposes or the combination thereof. The illuminating devices may include various dimensions ranging from very small dimensions to very large dimensions. As the dimensions of the illuminating devices become larger, the amount of illumination the illuminating device projects typically increases. Similarly, as the dimensions of the illuminating devices becomes greater, the greater the decorative illumination.

However, as the dimensions of the illuminating device increase, the transportation, handling, utilization and or function may become problematic. A need has existed to provide a illuminating device that provides both a illuminating purpose, and or a decorative purpose with a larger dimension that is easily transported, handled, utilized and or functions easily.

There have been many in the prior art who have attempted to solve these problems with varying degrees of success. None, however completely satisfies the requirements for a complete solution to the aforestated problem. The following U.S. Patents and Patent Applications are attempts of the prior art to solve this problem.

U.S. Pat. No. 6,769,793 to Hornsby discloses a cover surrounds an expandable frame that, when expanded, shapes the cover in a decorative fashion. The flame includes a plurality of flexible rods interconnected between two base units. As the base units are moved towards one another, the rods flex outwardly to form a somewhat spherical configuration. The rods are tapered at one or both ends to help facilitate a circular curvature.

U.S. Pat. No. 6,474,843 to Shieh discloses a globular decorative light assembly with a flexible supporting frame is disclosed. The flexible supporting frame includes a top fixed ring provided with a central hole, a bottom fixed ring arranged corresponding to the top fixed ring, a central pulling rope, and a plurality of flexible supporting sticks. Each of the flexible supporting sticks is pivotally arranged around the top fixed ring, while the bottom end of each flexible supporting sticks is pivotally arranged around the bottom fixed ring, thereby forming the flexible supporting frame for the globular decorative light assembly. The flexible supporting frame may be unfolded or folded by means of operating the central pulling rope. A net is covered on the flexible supporting frame, and the net may further incorporate with a plurality of light units arranged thereon for decoration.

U.S. Pat. No. 6,401,404 to Fillipp discloses a decorative, spherically shaped structure formed by a plurality of circumferentially spaced, elongated, pivotably interconnected ribs that lie in substantially coplanar, contiguous relation to each other when not expanded, but are readily expandable to form a discontinuous, substantially spherical body having top and bottom hub sections formed by end panels unitarily molded onto the ends of each rib. The pivotable interconnection between adjacent ribs is achieved by providing tabs on the end panels, the tabs having cylindrical apertures cooperatively alignable with mating tabs of adjacent ribs, permitting such cooperatively aligned tabs to be pinned or riveted together to form an integral structure. The end panels of each molded rib preferably further comprise cooperatively engageable lips having stepped cross-sections that intermesh to form substantially continuous upper and lower hub surfaces providing strength and rigidity to the expanded sphere.

U.S. Pat. No. 5,629,057 to Wang discloses a skeletal structure is formed of at least 4 and usually 6-12 curved members, each pivotally connected together at their upper and at their lower ends so as to have a generally spherical shape resembling a pumpkin. The skeletal structure is collapsible so that the curved members are parallel to each other for packaging or storage. A string of miniature electrical lamps can be attached removably to the curved members for providing a decorative appearance to the skeletal structure.

U.S. Pat. No. 5,876,111 to Wu discloses an expandable and shrinkable decorative lighting string arrangement with a plurality of lamp bulbs, lamp bases, lamp holders, all connected by wires to form a lighting string. The lighting string is connected to a plurality of stands by a clamp. An axis connector forms a support for the ends of the stands, and the ends of the stands are movably connected to the axis connector to form an expandable volume and a shrunken volume. The expandable volume attains a decorative structure with the stands spaced from each other. The shrunken volume positions the stands adjacent to each other. A locking device locks the stands to the axis connector to cause the stands to form the decorative structure.

U.S. Pat. No. 8,764,234 to Acree discloses a decorative sphere comprised of a series of generally D-shaped open panels pivotally connected together. In one configuration, the panels can be pivoted or moved to a folded and collapsed position for storage. In another configuration, the panels can be expanded and held in a spaced apart relationship to where the individual panels form a sphere. One or more strands of lights can be integrally incorporated into the sphere.

U.S. Pat. No. 6,070,991 to Rumpel discloses a decorative light fixture is described in which a pair of frames are provided, each with a central hub section and with arms spaced angularly about the hub and formed in a semi-spherical configuration about a central point. A band releasably joins the pair of frames with their central points substantially coincidental along an axis in such a manner that the arms of both frames form a substantially spherical configuration. Socket mounts are provided on the arms at varying positions spaced substantially radially from the central points. The arms of each frame are bendable from substantially flat orientations in which the arms extend radially from the associated central hub, with the socket mounts spaced radially therefrom to releasably receive and mount lenses or, alternatively, conventional Christmas light sockets.

U.S. Pat. No. 5,645,343 to Rinehimer discloses a light-string holder having two hubs with a plurality of receptacles. One of the hubs attaches to an external suspension device.

The light-string holder has a plurality of lamp-cluster holders fabricated from a translucent material. The lamp-cluster holders have a central beam member with two connectors configured to mate with corresponding receptacles on each hub, and a tapered straight edge configured to mate with the other tapered straight edges of the other lamp-cluster holders, and a peripheral beam member with a plurality of lamp clamps recessed below the peripheral edge of the peripheral beam member. Each of the lamp clamps have a C-shaped member comprising a circular arc greater than degrees and of a diameter equal to or less than the diameter of a lamp socket, and where both the central beam member and the peripheral beam member have an I-beam cross section and a plurality of holes through the land area of the I-beam.

U.S. Pat. No. 5,893,636 to Babineaux discloses a portable lighting fixture includes a removable light-diffusing covering of predetermined light transmission character that is maintained in a substantially-spherical shape by an underlying frame. The frame consists of cage formed of a pair of spaced-apart rings that are joined to one another by a plurality of ribs. A harp for positioning a light bulb engages both the upper and lower rings of the cage whereby the height of the harp defines that of the cage of the assembled frame. The heights of the ribs are such that, as the distance between the rings of the cage is compressed through interengagement to the harp, they define the desired spherical shape for mounting the light-diffusing covering.

U.S. Pat. No. 5,776,578 to Dejaynes discloses a novelty design apparatus has an elongated body member with an outer surface and first and second ends. An elongated body member has an outer surface and first and second ends. A flexible elongated tube is slidably mounted on the outer surface of the body member. One end of the tube is secured to the first end of the body member with the remainder of the tube slidably and rotatably embracing the body member. The central portion of the tube has a plurality of elongated slits which expand into a variety of design configurations when the free end of the tube is rotated, and slidably moved towards the fixed end of the tube. A guard element or disk is secured to the elongated body member to prevent the expanded central portion of the tube from being crushed or distorted when the novelty member is placed on a flat surface with the elongated tube in its expanded position.

U.S. Pat. No. 6,305,827 to Nolle discloses a transportable lamp comprising at least one lighting device, which is received in a holding device and acted upon by voltage via a feed cable. The lighting device has an at least partly transparent lamp screen. So that the lamp screen can be continuously and safely opened, a holding device is designed in the form of a bar and at least partly enclosed by the lamp screen. The lamp screen is held by movable tensioning means which, during use, are moved away from the lighting device, abutting the curvature of the lamp screen. Continuous and safe opening of the lamp screen is achieved under difficult working conditions, because the lamp is extremely robust and insensitive to damage.

Although the aforementioned prior art have contributed to the development of the art of illuminating devices, none of these prior art patents have solved the needs of this art.

Therefore, it is an object of the present invention to provide an illuminating device for illuminating purposes.

Another object of this invention is to provide an improved illuminating device for decorative purposes.

Another object of this invention is to provide an improved illuminating device that may transitioned from and expanded configuration to a contracted configuration.

Another object of this invention is to provide an improved illuminating device that is simple for the user to use.

Another object of this invention is to provide an illuminating device that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an illuminating device comprises a lower base having a plurality of lower pivot receivers. An upper base has a plurality of upper pivot receivers. A plurality of rods extend between a proximal end and a distal end. A plurality of lower pivots are coupled to the proximal end of the plurality of rods and engage the plurality of lower pivot receivers. A plurality of upper pivots are coupled to the distal end of the plurality of rods and engage the plurality of upper pivot receivers. The plurality of rods convert between a general linear configuration and a general arcuate configuration upon converging the lower base with the upper base. The plurality of rods convert between the general arcuate configuration and the general linear configuration upon diverging the lower base with the upper base. A lock extends between the lower base and the upper base for terminating displacement of the lower base relative to the upper base. An illuminating device is coupled to the plurality of rods.

In a more specific embodiment of the invention, the illuminating device includes a plurality of illuminating devices extending between the proximal end and the distal end of the plurality of rods. The plurality of rods define a general cylindrical body in the linear configuration. The plurality of rods define a general globe body in the arcuate configuration. The plurality of illuminating devices define a general illuminated cylindrical body in the linear configuration. The plurality of illuminating devices define a general illuminated globe body in the arcuate configuration.

In an another embodiment of the invention, the lower base includes a replaceable electrical power source.

In an another embodiment of the invention, the lower base includes an electrical circuit coupled to the plurality of illuminating devices for selectively activating and deactivating the plurality of illuminating devices for creating an illuminating pattern.

In an another embodiment of the invention, the lower base includes an electrical circuit coupled to the plurality of illuminating devices for selectively activating and deactivating the plurality of illuminating devices for creating a cylindrical illuminating pattern in the general cylindrical body and a global illuminating pattern in the general globe body.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
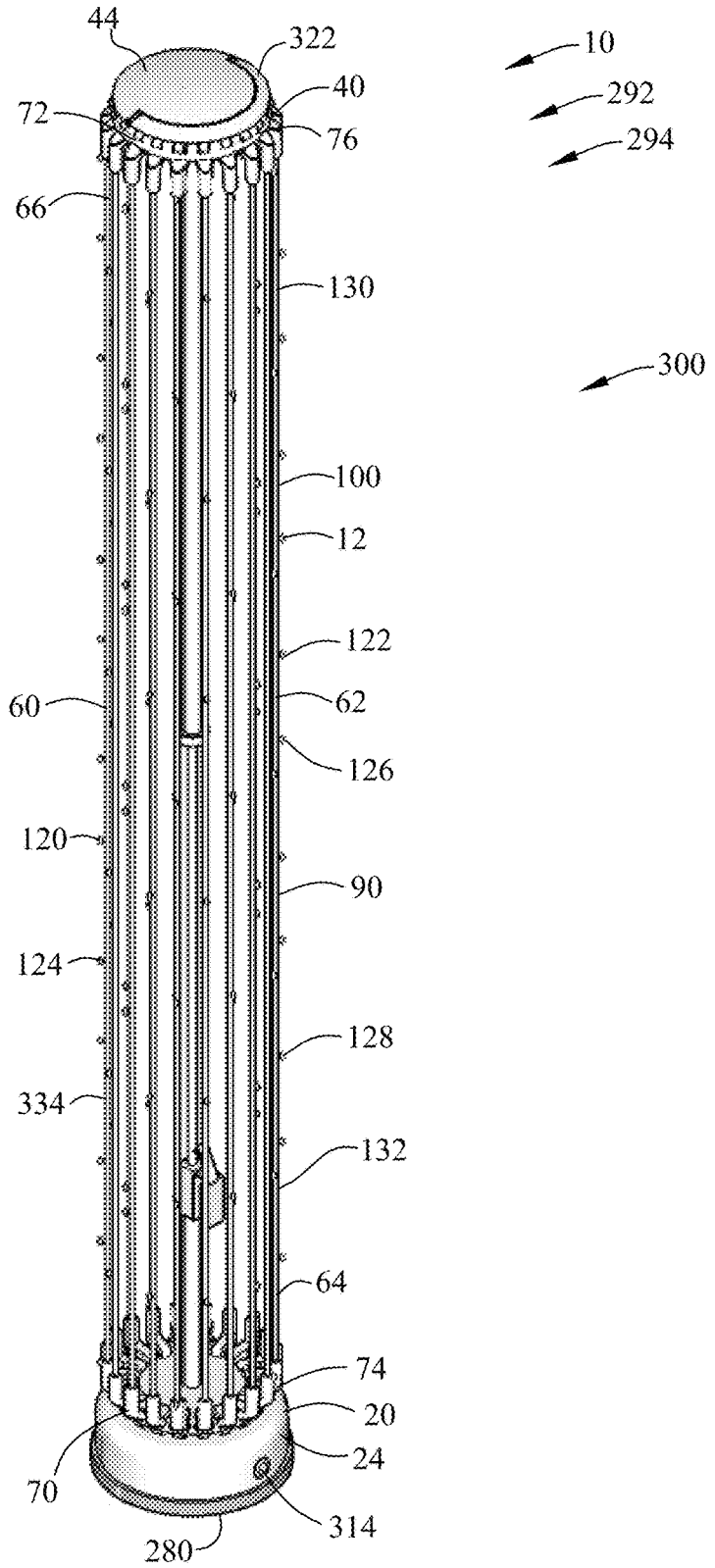
FIG. 1 is a front upper isometric view of a first embodiment for an illuminating device incorporating the present invention.
Figure 2:
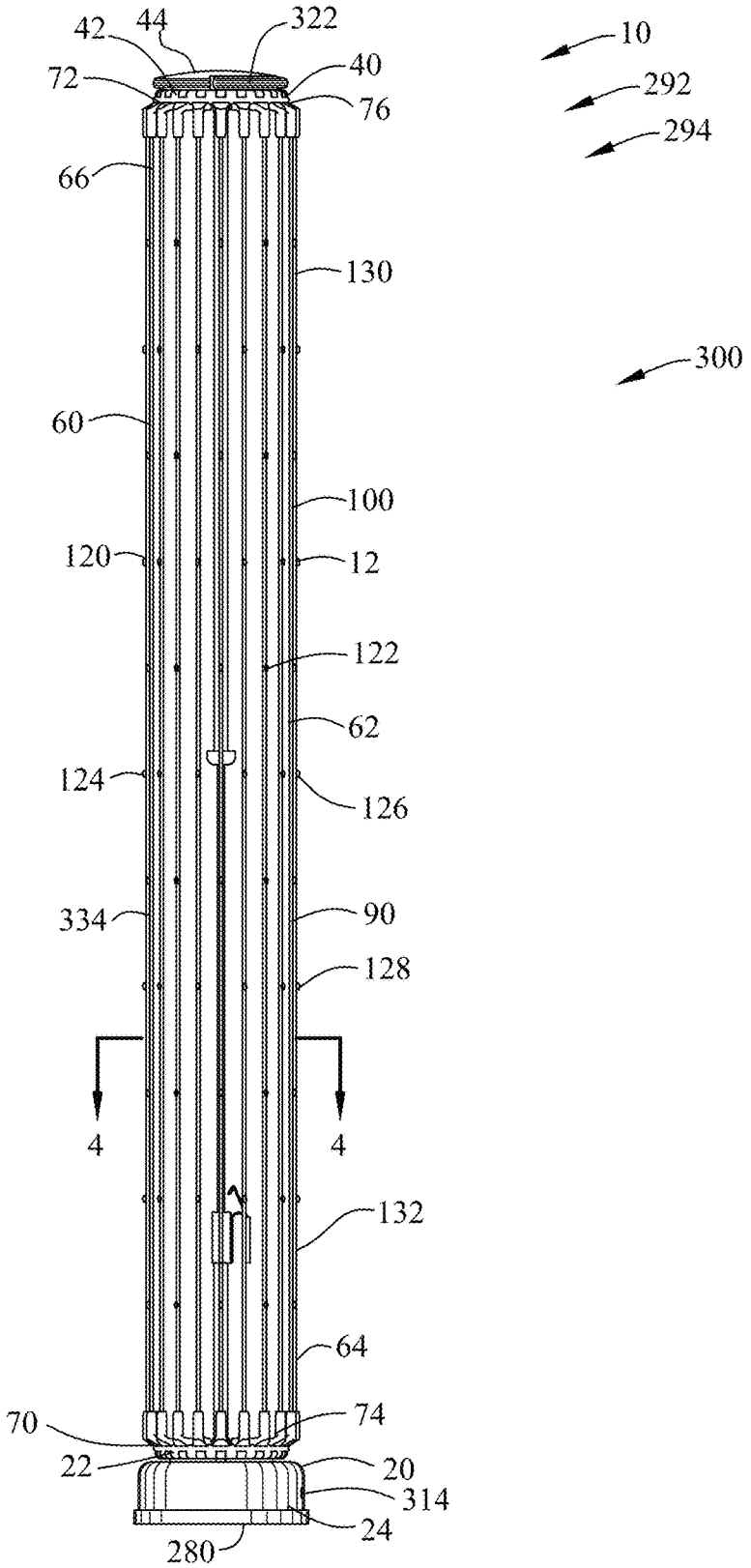
FIG. 2 is a front view of FIG. 1.
Figure 3:
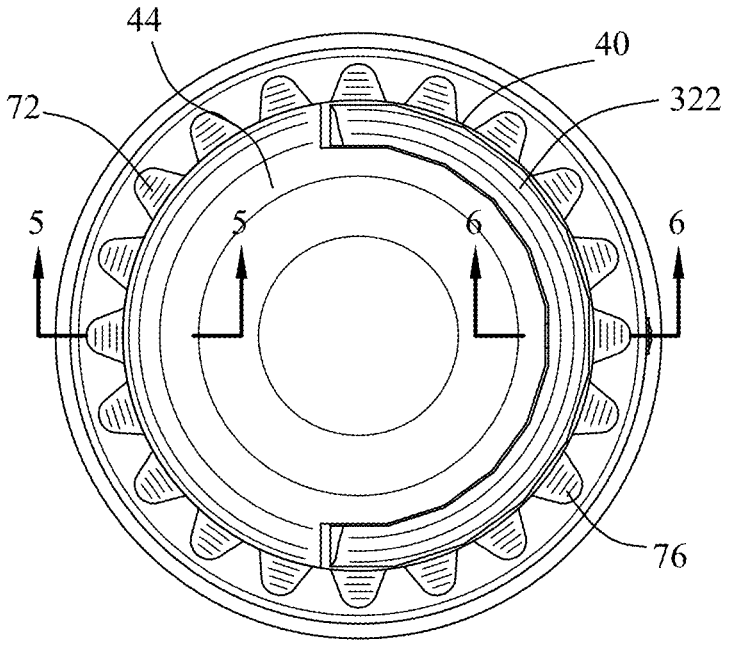
FIG. 3 is a top view of FIG. 2.
Figure 4:
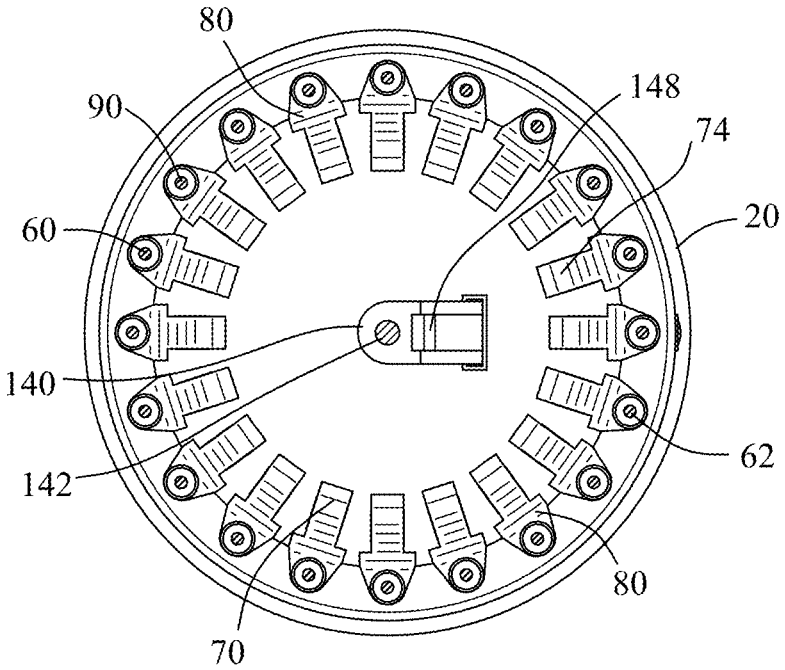
FIG. 4 is a sectional view along line 4-4 in FIG. 2.
Figure 6:
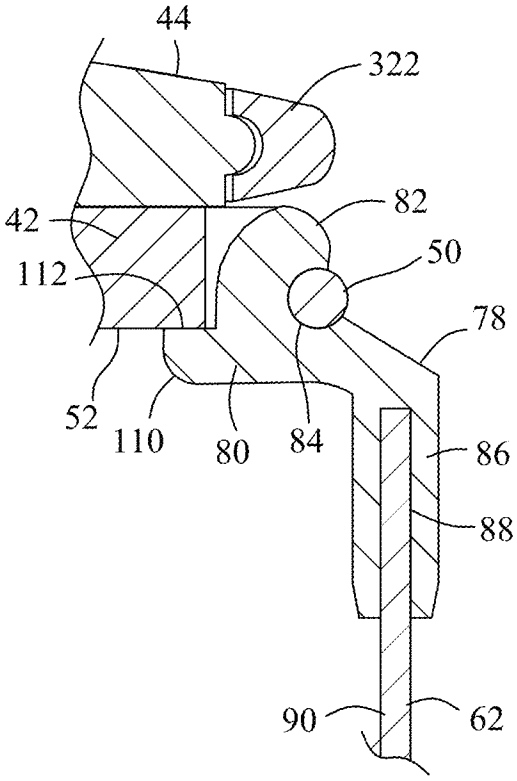
FIG. 6 is a sectional view along line 6-6 in FIG. 3.
Figure 5:
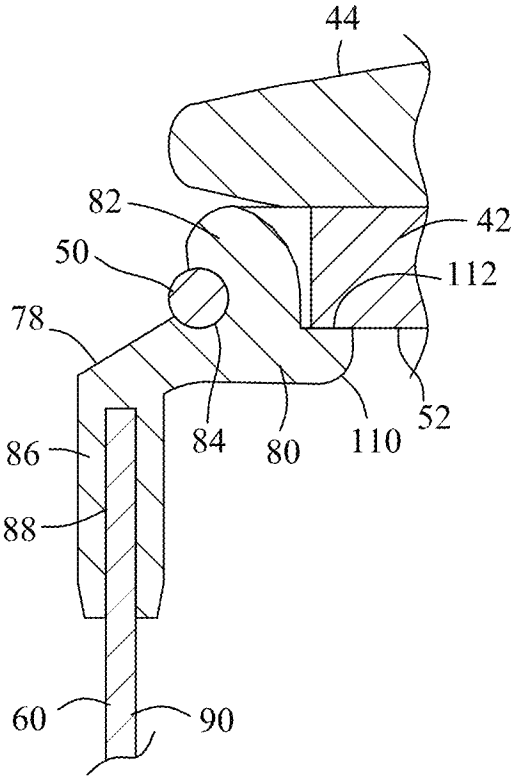
FIG. 5 is a sectional view along line 5-5 in FIG. 3.
Figure 7:
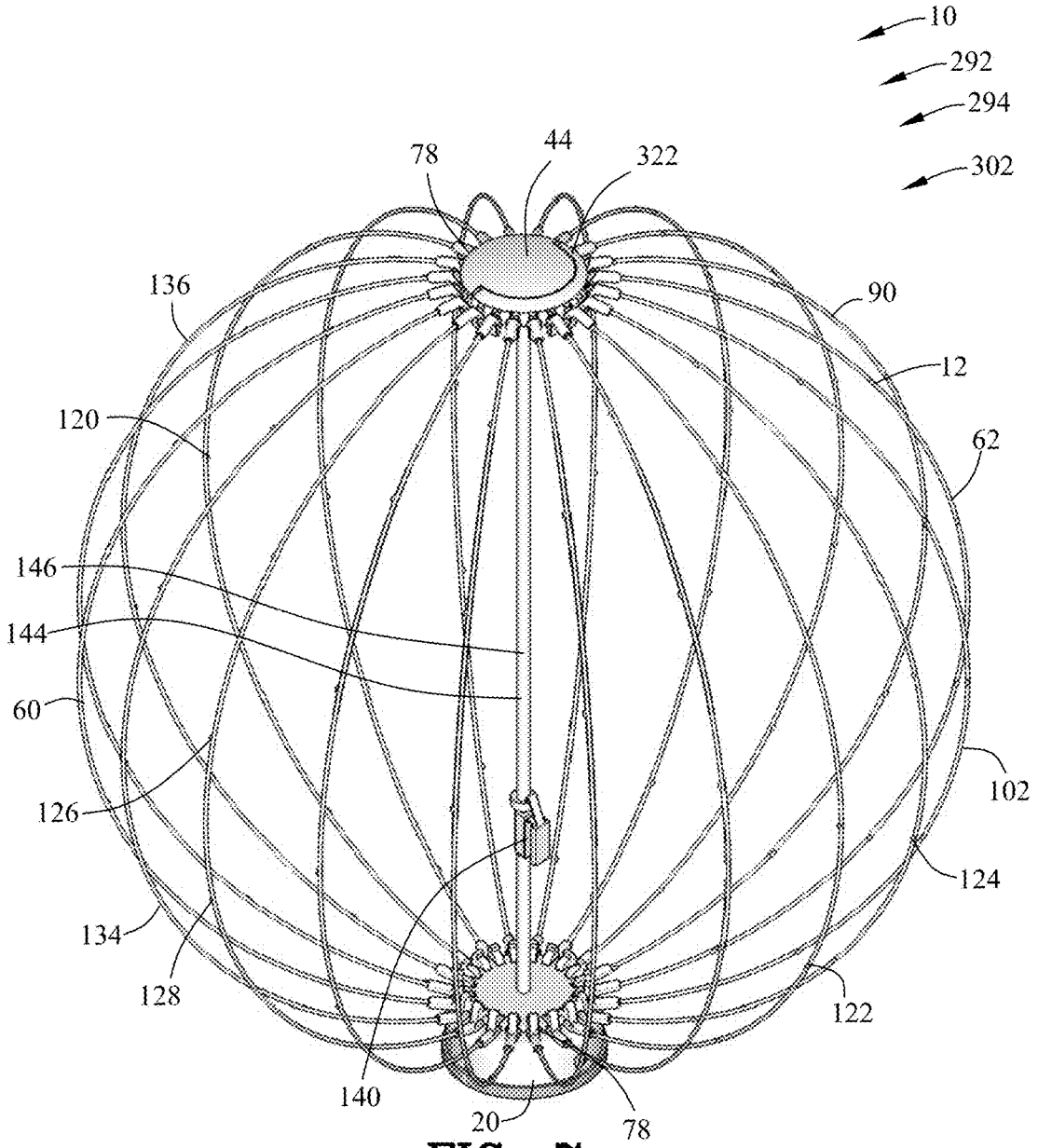
FIG. 7 is a view similar to FIG. 1 illustrating the illuminating device in a general globe body configuration.
Figure 8:
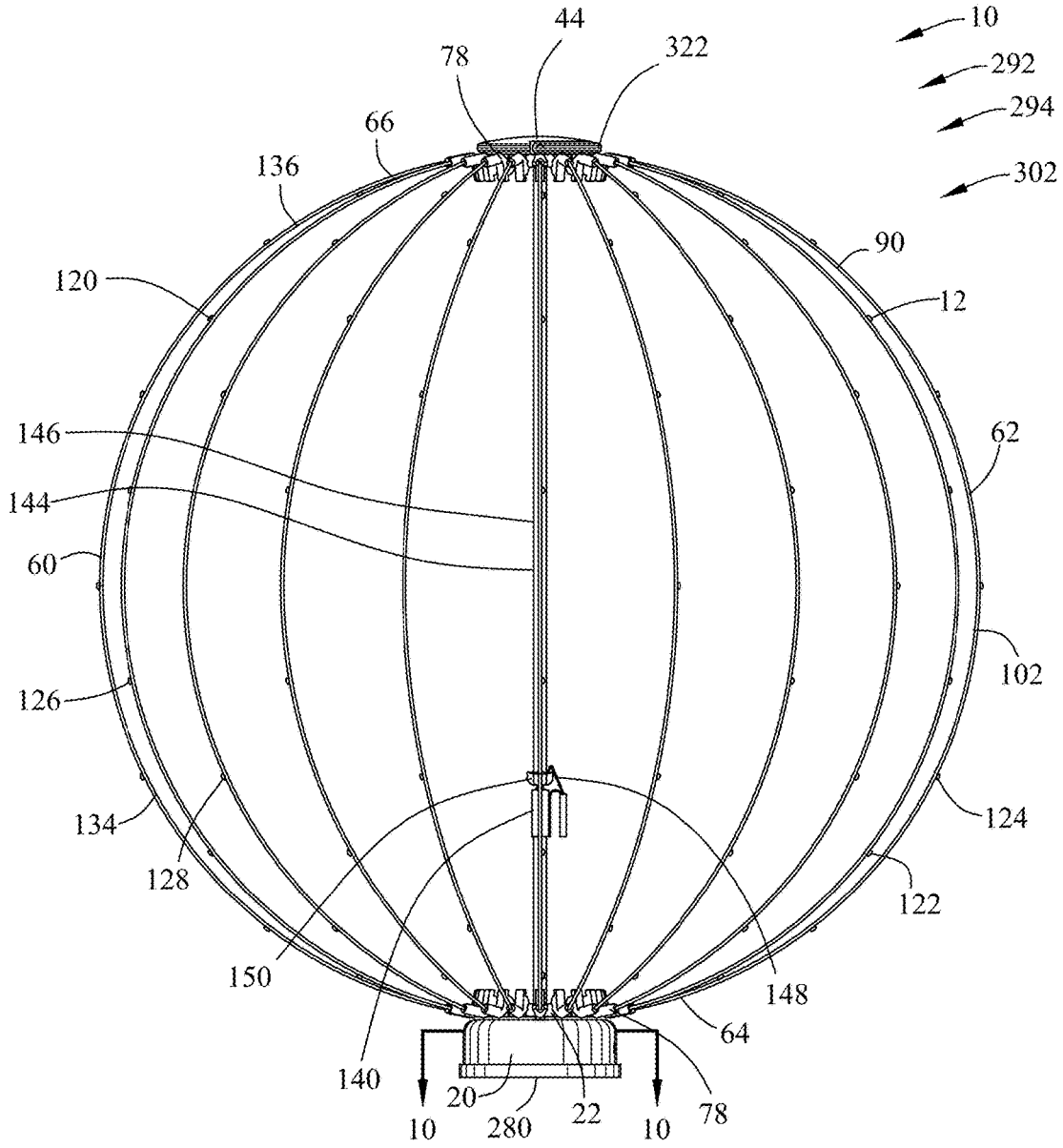
FIG. 8 is a front view of FIG. 7.
Figure 9:
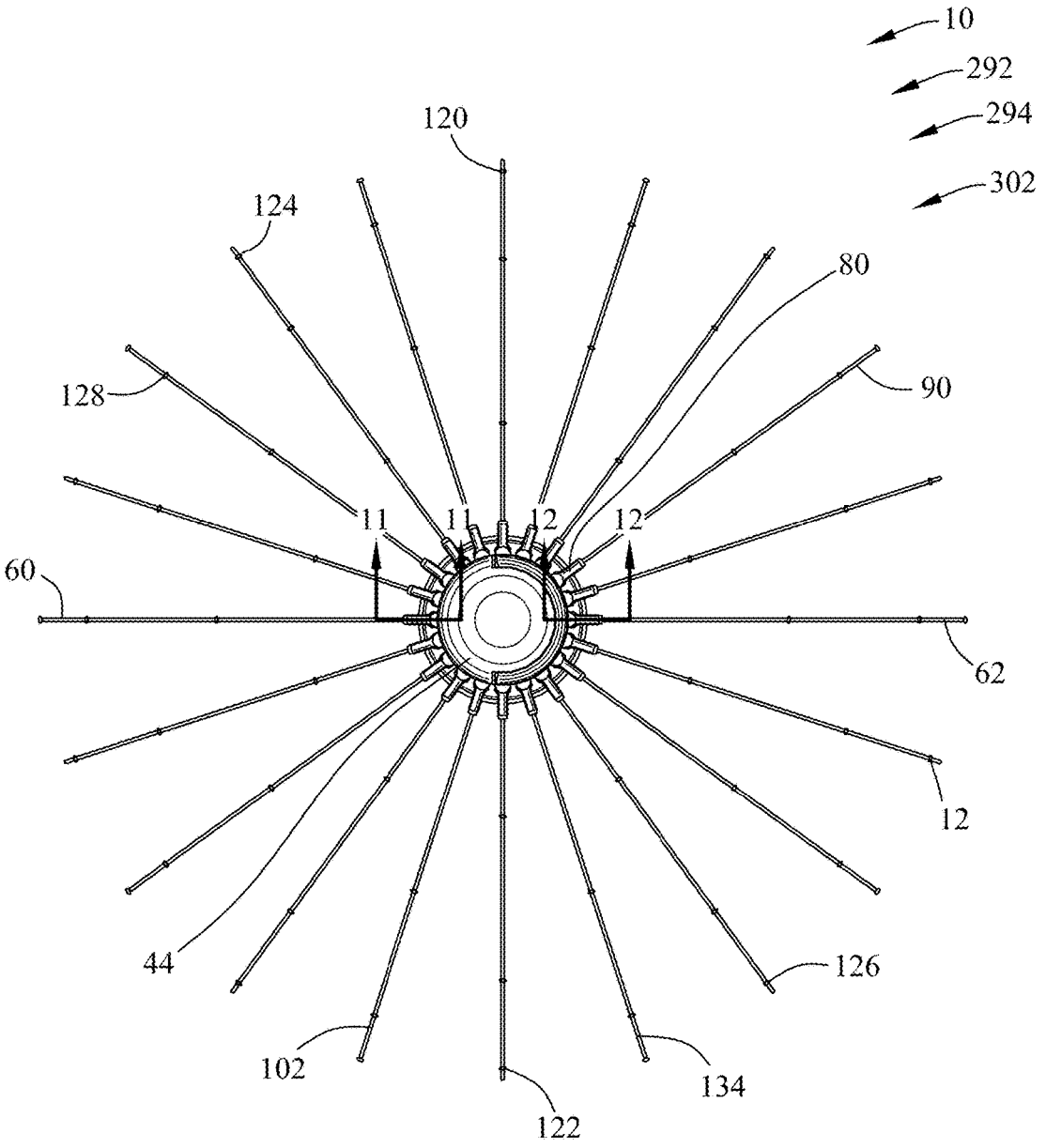
FIG. 9 is a top view of FIG. 8.
Figure 10:
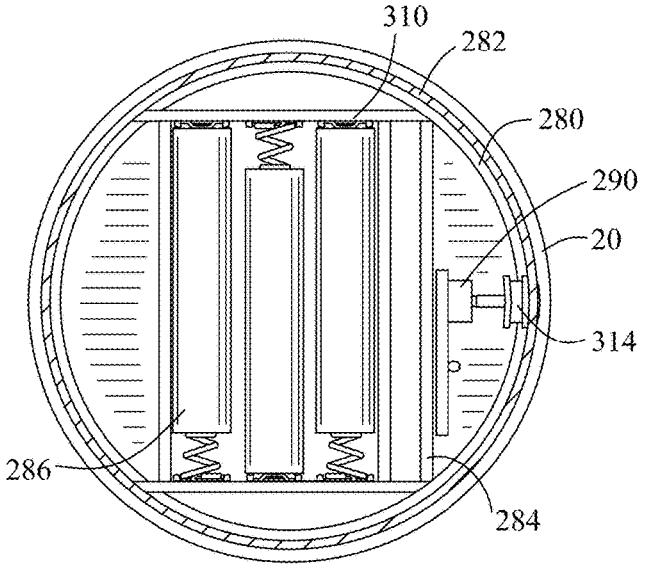
FIG. 10 is a sectional view along line 10-10 in FIG. 8.
Figure 11:
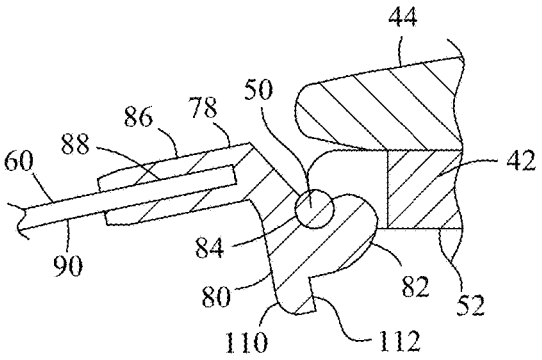
FIG. 11 is a sectional view along line 11-11 in FIG. 9.
Figure 12:
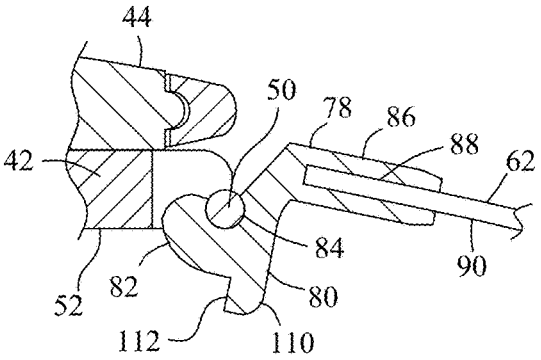
FIG. 12 is a sectional view along line 12-12 in FIG. 9.
Figure 13:
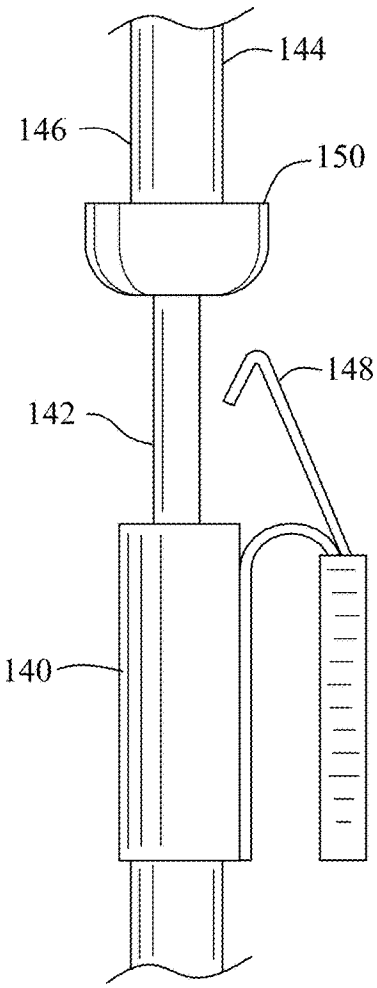
FIG. 13 is an enlarged portion of FIG. 8 illustrating a lock being disengaged for permitting displacement of the illuminating device.
Figure 14:
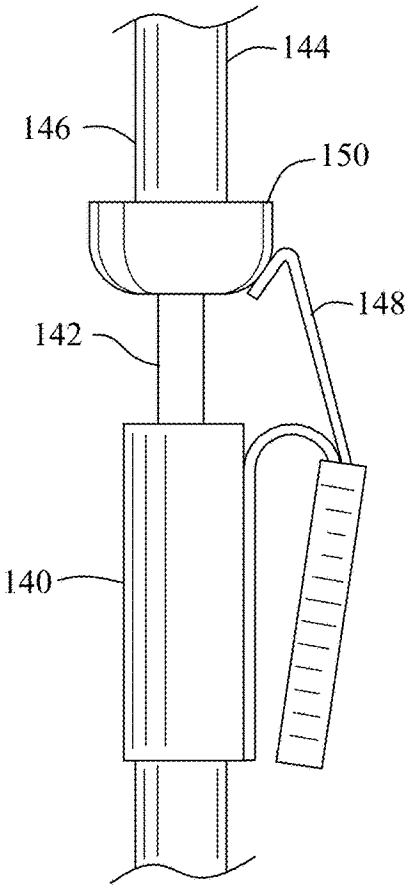
FIG. 14 is a view similar to FIG. 13 illustrating the lock in the process of being engaged.
Figure 15:
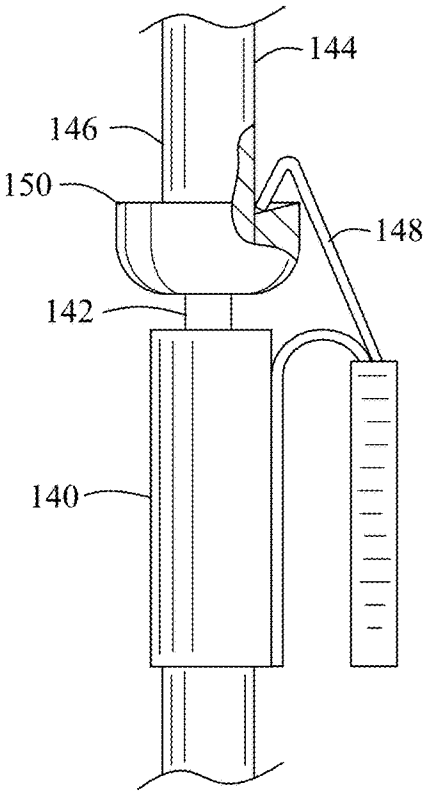
FIG. 15 is a view similar to FIG. 14 illustrating the lock being engaged for terminating displacement of the illuminating device.
Figure 56:
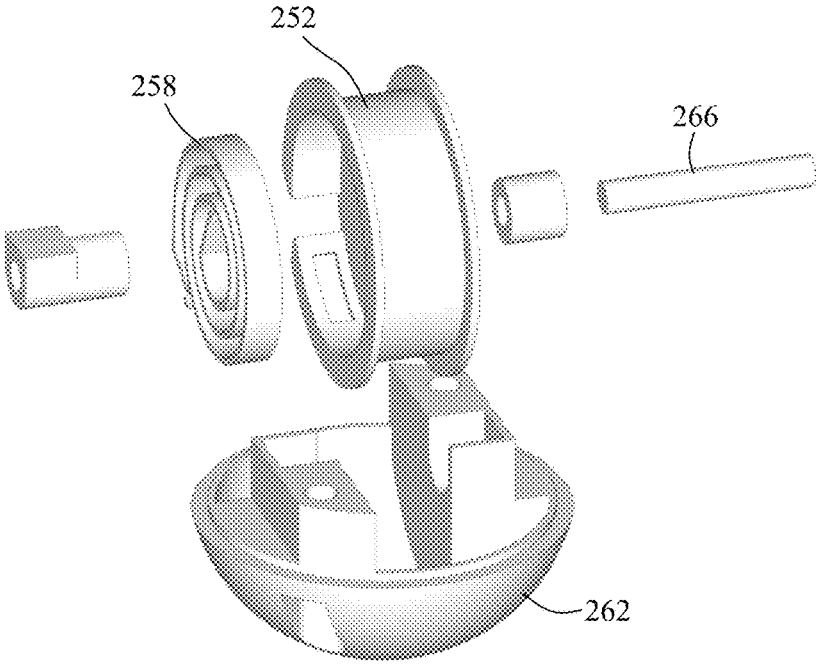
FIG. 56 is a secondary exploded view of FIG. 51.

FIGS. 1-56 illustrate an illuminating device 10 for emitting an illuminating energy 12. The illuminating device 10 includes a lower base 20 and an upper base 40 coupled by a first rod 60 and a second rod 62. A first illuminating device 120 is coupled to the first rod 60 and a second illuminating device 122 is coupled to the second rod 62.

FIGS. 1-30 illustrate a first embodiment for the illuminating device 10. The lower base 20 includes a lower hub 22 and a housing 24. The lower hub 22 includes a plurality of lower pivot receivers 26. Each of the lower pivot receivers 26 include a recessed groove 28 positioned behind a pivot shaft 30. The lower hub 22 has an upper stopping plate 32. Preferably, the lower base 20 includes a circular disk structure for positioning the plurality of lower pivot receivers 26 in an equally spaced circular pattern about the circumference of the lower hub 22.

The upper base 40 includes an upper hub 42 and a cap 44. The upper hub 42 includes a plurality of upper pivot receivers 46. Each of the upper pivot receivers 46 include a recessed groove 48 positioned behind a pivot shaft 50. The upper hub 42 has an upper stopping plate 32.

Both the first rod 60 and the second rod 62 extend between a proximal end 64 and a distal end 66. The first rod 60 and the second rod 62 may be constructed one from fiberglass, polymeric, metallic, carbon fiber or other materials in which supply the energy, structural memory and ability to withstand the required temperature ranges.

A first lower pivot 70 is coupled to the proximal end 64 of the first rod 60 and engages one of the lower pivot receivers 26. A first upper pivot 72 is coupled to the distal end 66 of the first rod 60 and engages one of the upper pivot receivers 46. Similarly, a second lower pivot 74 is coupled to the proximal end 64 of the second rod 62 and engages one of the lower pivot receivers 26. A second upper pivot 76 is coupled to the distal end 66 of the second rod 62 and engages one of the upper pivot receivers 46.

Preferably, the first lower pivot 70, the first upper pivot 72, the second lower pivot 74 and the second upper pivot 76 are equivalent in structure and may be referred as pivot joints 78. The pivot joints 78 include a pivot base 80. A pivot arm 82 extends from the pivot base 84 for defining a pivot bore 84. The pivot arm 82 includes dimensions to be inserted into the recessed grooves 28 and 48. Furthermore, the pivot bore 84 includes dimensions for being snapped over the pivot shafts, 30 and 50.

A rod receiver 86 further extends from the pivot base 84 for defining a rod socket 88. The first rod 60 and the second rod 62 may be coupled to the pivot joints 78 by inserting the first rod 60 and the second rod 62 in the rod socket 88.

Preferably, a plurality of rods 90 and a plurality of pivot joints 78 engage the plurality of lower pivot receivers 26 in an equally spaced circular pattern about the circumference of the lower hub 22 and engaged the plurality of upper pivot receivers 46 in an equally spaced circular pattern about the circumference of the upper hub 42.

The plurality of rods 90 may be converted between a general linear configuration 100 as shown in FIGS. 1-6 to a general arcuate configuration 102 as shown in FIGS. 7-9, 11, 12, 16 and 17 upon converging or compressing the lower base 20 with the upper base 40. The pivot grooves 84 have a center of rotation that is offset from the plurality of rods 90 for ensuring that the plurality of rods 90 form the general arcuate configuration 102 to the exterior of the illuminating device 10 as opposed to bending inwardly. In addition, the recessed grooves 28 serve to guide the pivot arms 82 during pivoting and maintain even a separation between the plurality of rods 90. Furthermore, the engagement between the recessed grooves 28 and the pivot arms 82 at stability to the illuminating device 10 while in the general arcuate configuration 102.

Alternatively, the plurality of rods 90 may be converted between the general arcuate configuration 102 as shown in FIGS. 7-9, 11, 12, 16 and 17 to the general linear configuration 100 as shown in FIGS. 1-6 upon diverging the lower base 20 with the upper base 40.

A stopping arm 110 extends from the pivot base 84 for defining a stopping surface 112. The stopping surface 112 engages with the upper stopping plate 52 for terminating pivoting of the pivot joints 78 in the general linear configuration 100. Furthermore, the engagement between the stopping surface 112 engages with the upper stopping plate 52 assures that upon the converging displacement of the lower base 20 with the upper base 40 that the plurality of rods 90 form the general arcuate configuration 102 to the exterior of the illuminating device 10 as opposed to bending inwardly.

In order for maintaining the illuminating device 10 in the general arcuate configuration 102 a lock 140 may be utilized. The lock 140 may extend between the lower base 20 and the upper base 40 for terminating displacement of the lower base 20 relative to the upper base 40. The lock 140 may include a primary tube 142 coupled to the lower base 20 and a secondary tube 144 coupled to the upper base 40 for slidably engaging and defining a telescoping elongated member 146. A clip 148 is pivotably couple to the telescoping elongated member 146. A clip receiver 150 is coupled to the telescoping elongated member 146. The clip 148 engages with the clip receiver 150 for terminating displacement of the primary tube relative to the secondary tube and maintaining the illuminating device 10 in the general arcuate configuration 102. To return the illuminating device 10 to the general linear configuration 100 the clip is depressed disengaging the clip receiver 150 and permitting displacement of the primary tube 142 relative to the secondary tube 144.

Since the plurality of rods 90 have a potential return energy from the general arcuate configuration 102, upon disengaging the clip 148 from the clip receiver 150 the plurality of rods 90 utilize the bowed potential return energy to distance the lower base 20 from the upper base 40 and converted between the general arcuate configuration 102 as shown in FIGS. 7-9, 11, 12, 16 and 17 to the general linear configuration 100 as shown in FIGS. 1-6.

FIGS. 31-56 illustrate a second embodiment for the illuminating device 10. A lower base 160 includes a lower hub 162 between a primary lower housing 164 and a secondary lower housing 166. The lower hub 162 includes a primary lower disk 170 having a plurality of primary lower partial pivot receivers 172 and a secondary lower disk 174 having a plurality of secondary lower partial pivot receivers 176. The primary lower disk 170 and the secondary lower disk 174 engage together so that the plurality of primary lower partial pivot receivers 172 and the plurality of secondary lower partial pivot receivers 176 form a plurality of lower pivot receivers 180. Preferably, the lower hub 162 includes a circular disk structure for positioning the plurality of lower pivot receivers 180 in an equally spaced circular pattern about the circumference of the lower hub 162. Each of the lower pivot receivers 180 includes a disk channel 182 and a pivot shaft channel 184.

An upper base 160 includes an upper hub 192 between a primary upper housing 194 and a secondary upper housing 196. A cap 198 is positioned above the secondary upper housing 196. The upper hub 192 includes a primary upper disk 200 having a plurality of primary upper partial pivot receivers 202 and a secondary upper disk 204 having a plurality of secondary upper partial pivot receivers 206. The primary upper disk 200 and the secondary upper disk 204 engage together so that the plurality of primary upper partial pivot receivers 202 and the plurality of secondary upper partial pivot receivers 206 form a plurality of upper pivot receivers 210. Preferably, the upper hub 192 includes a circular disk structure for positioning the plurality of upper pivot receivers 210 in an equally spaced circular pattern about the circumference of the upper hub 192. Each of the upper pivot receivers 210 includes a disk channel 212 and a pivot shaft channel 214.

Both the first rod 60 and the second rod 62 extend between a proximal end 64 and a distal end 66. The first rod 60 and the second rod 62 may be constructed one from fiberglass, polymeric, metallic, carbon fiber or other materials in which supply the energy, structural memory and ability to withstand the required temperature ranges.

A first lower pivot 220 is coupled to the proximal end 64 of the first rod 60 and engages one of the lower pivot receivers 180. A first upper pivot 222 is coupled to the distal end 66 of the first rod 60 and engages one of the upper pivot receivers 210. Similarly, a second lower pivot 224 is coupled to the proximal end 64 of the second rod 62 and engages one of the lower pivot receivers 180. A second upper pivot 226 is coupled to the distal end 66 of the second rod 62 and engages one of the upper pivot receivers 210.

Preferably, the first lower pivot 220, the first upper pivot 222, the second lower pivot 224 and the second upper pivot 226 are equivalent in structure and may be referred as pivot joints 228. The pivot joints 228 include a pivot disk 230. Pivot shafts 232 extend from the pivot disk 230. The pivot disk 230 and pivot shafts 232 include dimensions to be inserted into the disk channels 182, 212 and pivot shaft channels 184, 214 respectively for pivoting the pivot joints 228 relative to the lower hub 162 and upper hub 192.

A rod receiver 234 further extends from the pivot joints 228 for defining a rod socket 236. The first rod 60 and the second rod 62 may be coupled to the pivot joints 228 by inserting the first rod 60 and the second rod 62 in the rod socket 236.

Preferably, a plurality of rods 90 and a plurality of pivot joints 78 engage the plurality of lower pivot receivers 180 in an equally spaced circular pattern about the circumference of the lower hub 162 and engaged the plurality of upper pivot receivers 210 in an equally spaced circular pattern about the circumference of the upper hub 192.

The plurality of rods 90 may be converted between a general linear configuration 100 as shown in FIGS. 31-38 to a general arcuate configuration 102 as shown in FIGS. 39-43 upon converging or compressing the lower base 160 with the upper base 190. The pivot shafts 232 have a center of rotation that is offset from the plurality of rods 90 for ensuring that the plurality of rods 90 form the general arcuate configuration 102 to the exterior of the illuminating device 10 as opposed to bending inwardly. In addition, the disk channels 182, 212 engagement with the pivot disk 230 serve to guide the pivot joints 228 during pivoting and maintain even a separation between the plurality of rods 90. Furthermore, the engagement between the disk channels 182, 212 with the pivot disk 230 promote stability in the illuminating device 10 while in the general arcuate configuration 102.

Alternatively, the plurality of rods 90 may be converted between the general arcuate configuration 102 as shown in FIGS. 39-43 to the general linear configuration 100 as shown in FIGS. 31-38 upon diverging the lower base 160 with the upper base 190.

A lower stopping surface 240 is defined within the secondary lower housing 166 of the disk channel 182. An upper stopping surface 242 is defined within the secondary upper housing 196 of the disk channel 212. The lower stopping surface 240 engages with the rod receiver 234 for terminating pivoting of the pivot joints 228 in the general linear configuration 100. Similarly, upper stopping surface 242 engages with the rod receiver 234 for terminating pivoting of the pivot joints 228 in the general linear configuration 100. The engagement between the lower stopping surface 240 and the upper stopping surface 242 assures that upon the converging displacement of the lower base 160 with the upper base 190 that the plurality of rods 90 form the general arcuate configuration 102 to the exterior of the illuminating device 10 as opposed to bending inwardly.

In order for maintaining the illuminating device 10 in the general arcuate configuration 102 a lock 250 may be utilized. The lock 250 may extend between the lower base 160 and the upper base 190 for terminating displacement of the lower base 160 relative to the upper base 190. More specifically, the lock 250 may include a wheel 252 rotatably coupled to the upper base 190. A tether 254 encircles the wheel 252 and is coupled to the lower base 160. A wheel pin 256 slidably engages within the upper base 190 and engages the wheel 252 for terminating rotation of the wheel 252 or disengaging the wheel 252 for permitting rotation of the wheel 252. A spiral spring 258 engages the wheel 252 for rotating the wheel 252 and winding the tether 254 about the wheel 252 upon the wheel pin 256 disengaged with the wheel 252 and the lower base 160 converging with the upper base 190.

The primary upper disk 200 and the secondary upper disk 204 include a wheel slot 260 for receiving the wheel 252. A lower wheel cap 262 and an upper wheel cap 264 are positioned adjacent to the upper hub 192 for supporting the wheel 252 within the wheel slot 260. A wheel shaft 266 is inserted through the wheel 252 for rotatably mounting the wheel 252 within the wheel slot 260. A spring set pin is inserted within the spiral spring 258 engages the wheel 252 for mounting the spiral spring 258 within the wheel 252.

An activation button 270 slidably engages the cap 198. A rocker arm 272 is pivotably coupled to the upper wheel cap 264 and receives a displacement force from activation button 270. The rocker arm 272 upon displacement causes the wheel pin 256 to be withdrawn from contact with the wheel 252. A pin spring 274 causes the wheel pin 256 to be displaced back into contact with the wheel 252 upon the displacement force being removed from the activation button 270. As such, when the displacement force has been removed from the activation button 270, the wheel 252 will be locked for maintaining the lower base 160 and the upper base 190 in that orientation. The distance between the lower base 160 and the upper base 190 may be adjusted in many different distances there between for altering the appearance of the illuminating device 10.

In addition, since the plurality of rods 90 have a potential return energy from the general arcuate configuration 102, upon disengaging the wheel pin 256 from the wheel 252 the plurality of rods 90 utilize the bowed potential return energy to distance the lower base 160 from the upper base 190 and converted between the general arcuate configuration 102 as shown in FIGS. 39-43 to the general linear configuration 100 as shown in FIGS. 31-38.

The first illuminating device may include a first plurality of illuminating devices 124 extending between the proximal end 64 and the distal end 66 of the first rod 60. Similarly, the second illuminating device 122 may include a second plurality of illuminating devices 126 extending between the proximal end 64 and the distal end 66 of the second rod 62. Furthermore, each of the plurality of rods 90 may include a plurality of illuminating devices 128 extending between the proximal end 64 and the distal end 66 of the plurality of rods 90. The spacing between the plurality of illuminating devices 128 may include a small spacing or a large spacing. The plurality of illuminating devices 128 may include an incandescent bulbs, fluorescent bulbs, LED bulbs and/or a chemiluminescence bulbs.

As shown in FIGS. 1-4, 31-38, the plurality of rods 90 defining a general cylindrical body 130 in the linear configuration 100. Furthermore, the plurality of illuminating device 128 define a general illuminated cylindrical body 132 in the linear configuration 100. As shown in FIGS. 7-9, 16, 17, 39-43, the plurality of rods 90 defining a general globe body 134 in the arcuate configuration 102. Furthermore, the plurality of illuminating devices 128 define a general illuminated globe body 136 in the arcuate configuration 102.

The lower base 20 and 160 includes a bottom supporting surface 280. The bottom supporting surface 280 may be utilized for resting the illuminating device 10 on a surface. The lower base 20 and 160 may include a removable cover 282 for exposing a base chamber 284. The base chamber 284 receives a replaceable electrical power source 286 such as a plurality of batteries for supplying an electrical current to the plurality of illuminating devices 128.

The lower base 20 and 160 may include an electrical circuit 290 coupled to the plurality of illuminating devices 128 for selectively activating and deactivating the plurality of illuminating devices 128 for creating an multiple illuminating patterns 292 such as twinkle, fade, flash and/or multiple colors 294. Furthermore, the electrical circuit 290 may selectively activate and deactivate the plurality of illuminating devices 128 for creating a cylindrical illuminating pattern 300 in the general cylindrical body 130 and a global illuminating pattern 302 in the general globe body 134.

Figure 17:
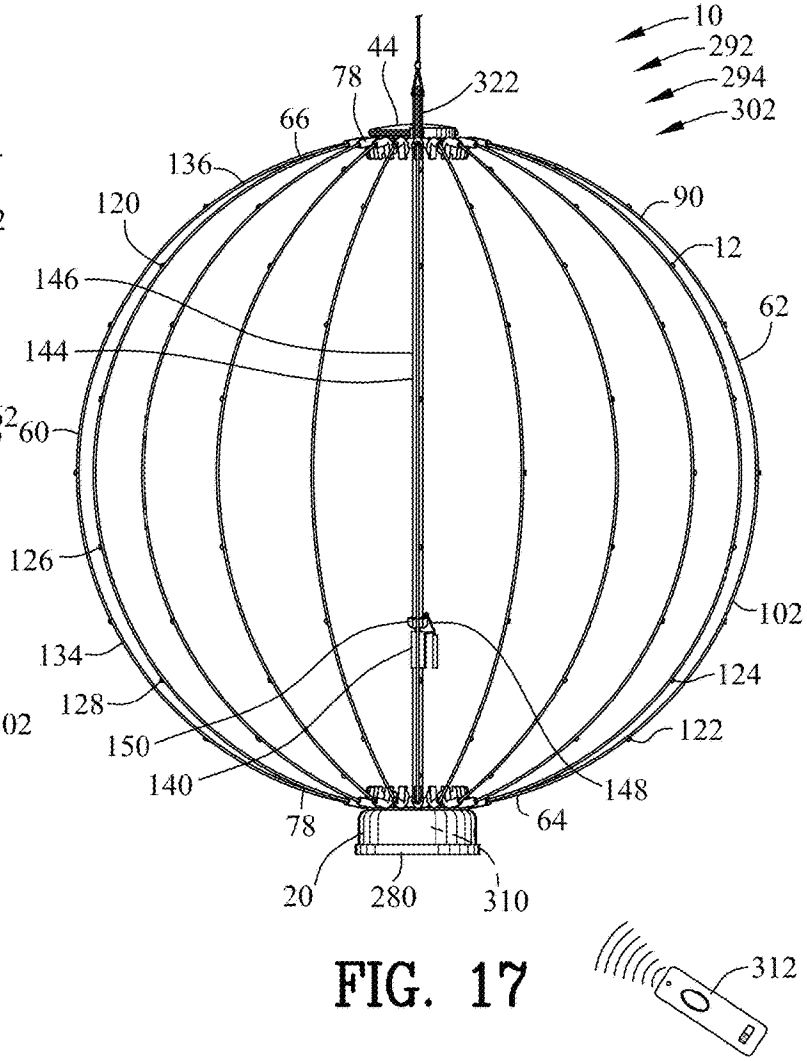
FIG. 17 is a view similar to FIG. 8 illustrating the illuminating device for suspending from an object and receiving a wireless signal from a wireless transmitter.
Figure 16:
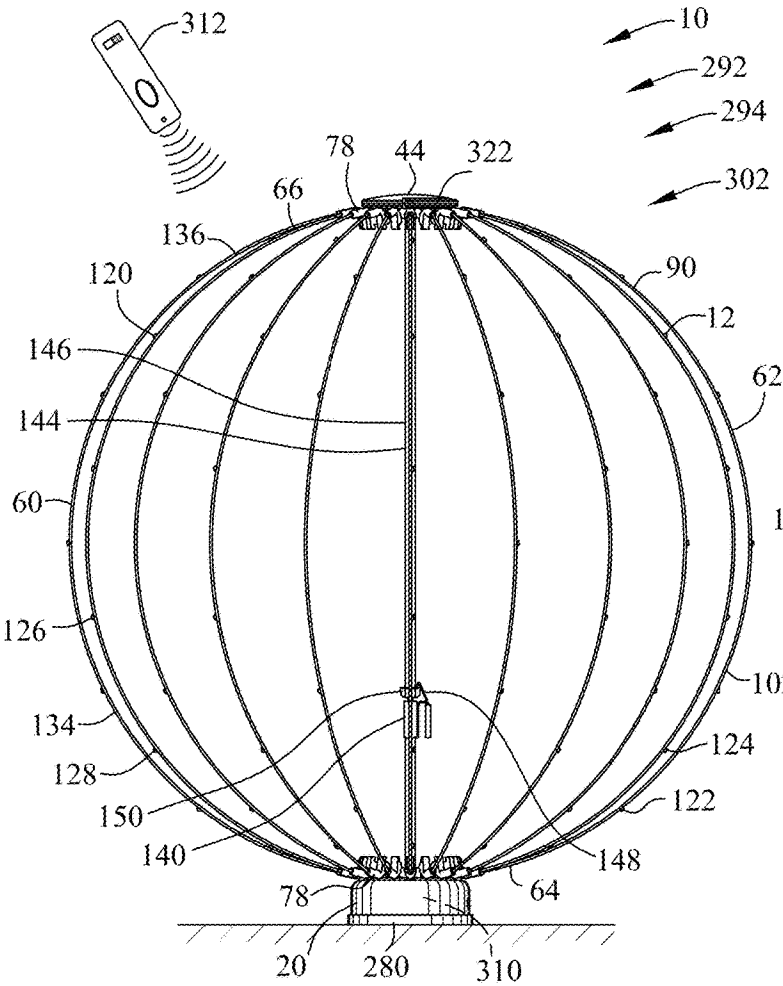
FIG. 16 is a view similar to FIG. 8 illustrating the illuminating device positioned onto a surface and receiving a wireless signal from a wireless transmitter.
Figure 18:
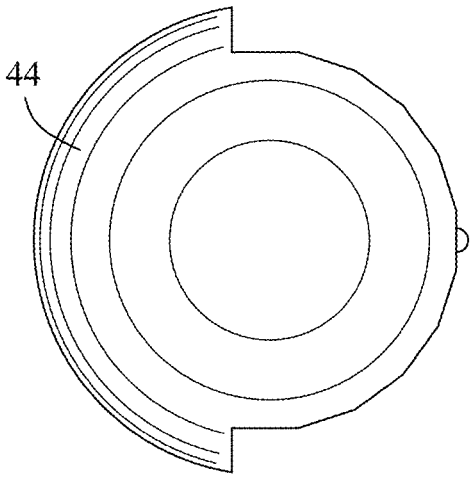
FIG. 18 is a top view of an upper cap in FIG. 1.
Figure 19:
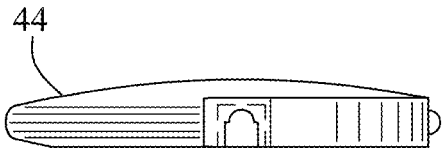
FIG. 19 is a side view of FIG. 18.
Figure 20:
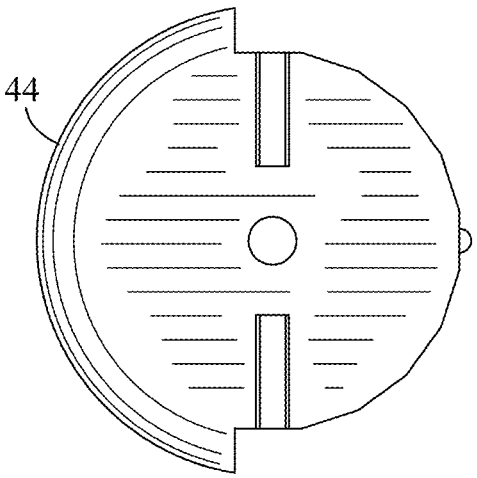
FIG. 20 is a bottom view of FIG. 18.
Figure 21:
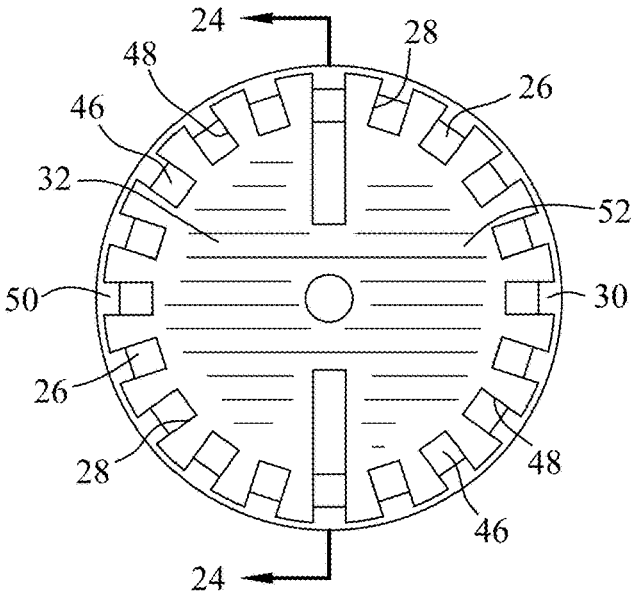
FIG. 21 is a top view of a hub in FIG. 1.
Figure 24:
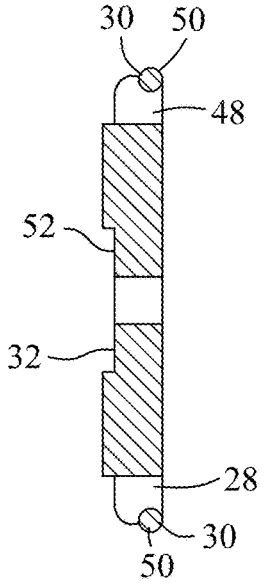
FIG. 24 is a sectional view along line 24-24 in FIG. 21.
Figure 22:
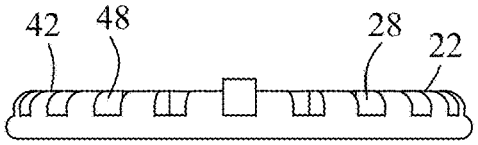
FIG. 22 is a side view of FIG. 21.
Figure 23:
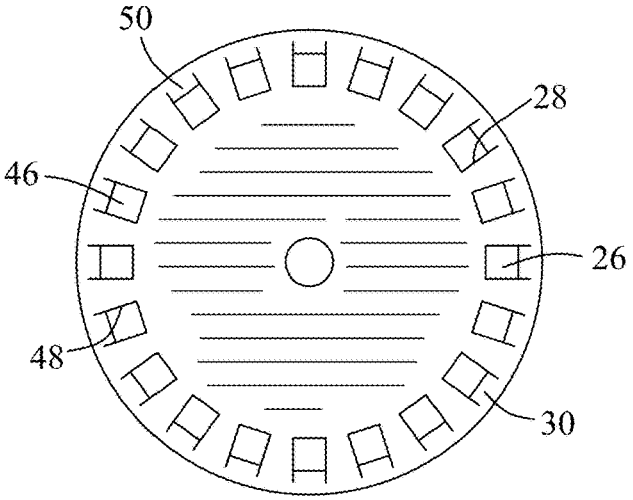
FIG. 23 is a bottom view of FIG. 21.
Figure 25:
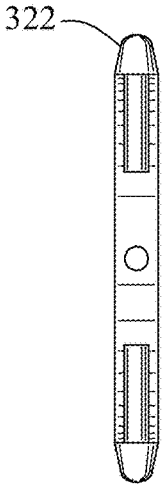
FIG. 25 is a bottom view of a hanger in FIG. 1.
Figure 26:
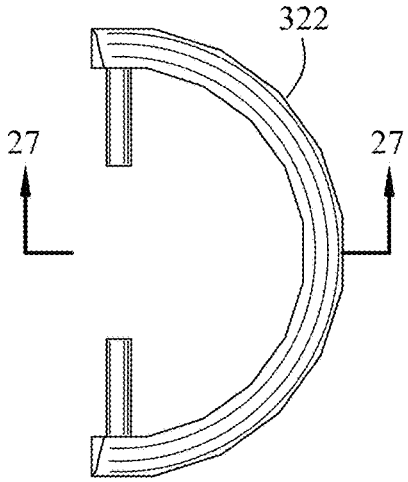
FIG. 26 is a side view of FIG. 25.
Figure 27:
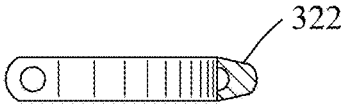
FIG. 27 is a sectional view along line 27-27 in FIG. 26.
Figure 28:
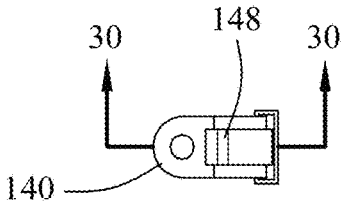
FIG. 28 is a top view of the lock in FIG. 1.
Figure 29:
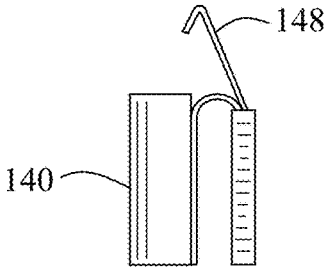
FIG. 29 is a side view of FIG. 28
Figure 30:
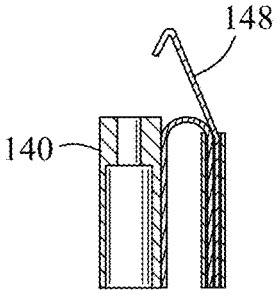
FIG. 30 is a sectional view along line 30-30 in FIG. 28.
Figure 31:
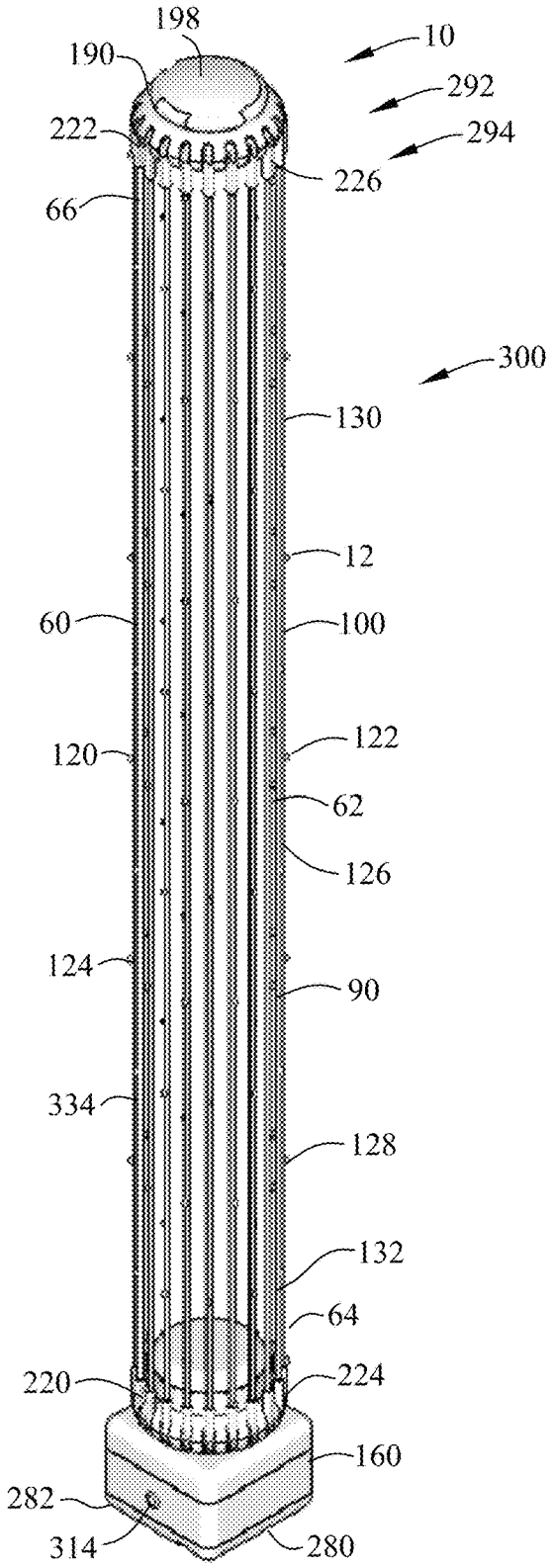
FIG. 31 is a front upper isometric view of a second embodiment for an illuminating device incorporating the present invention.
Figure 32:
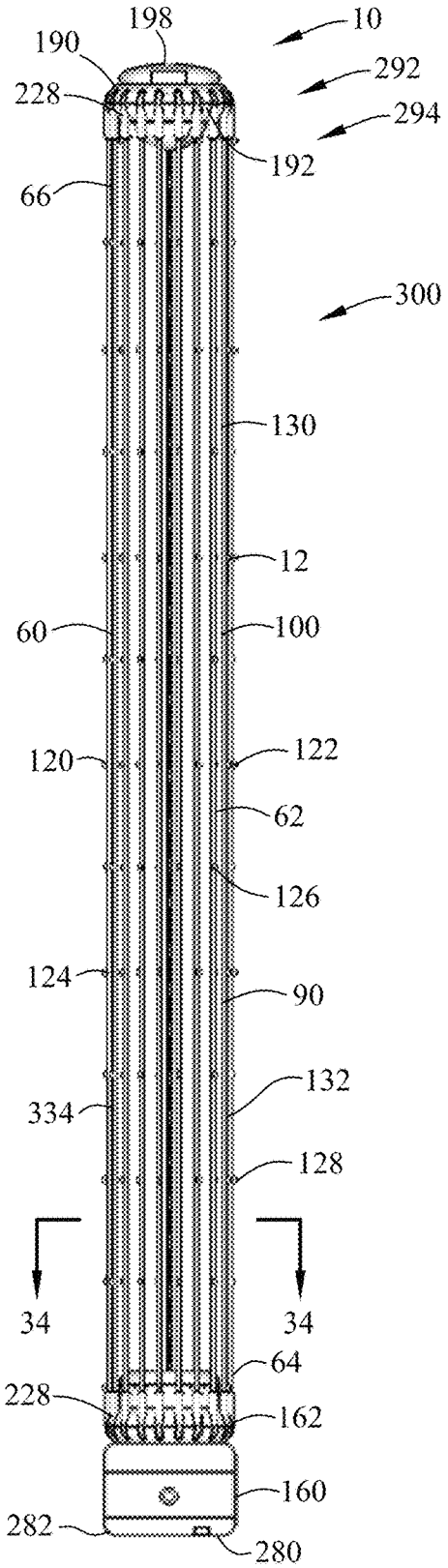
FIG. 32 is a front view of FIG. 31.
Figure 33:
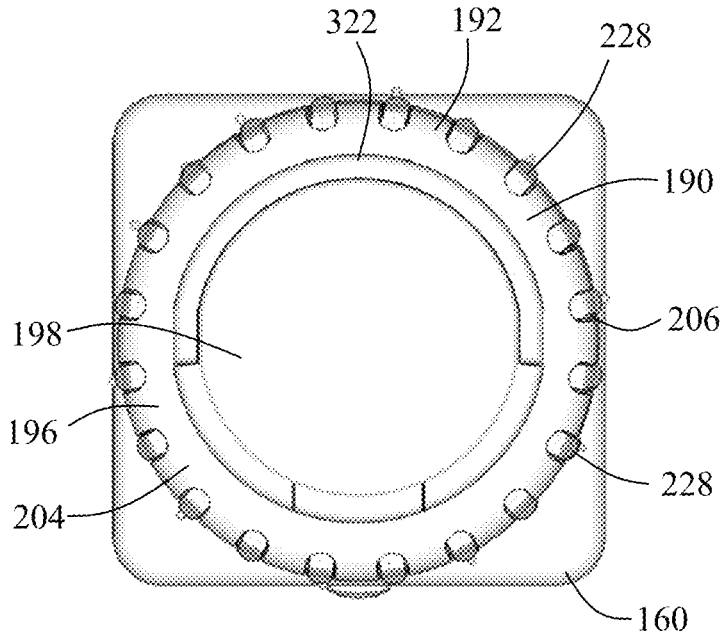
FIG. 33 is a top view of FIG. 32.
Figure 34:
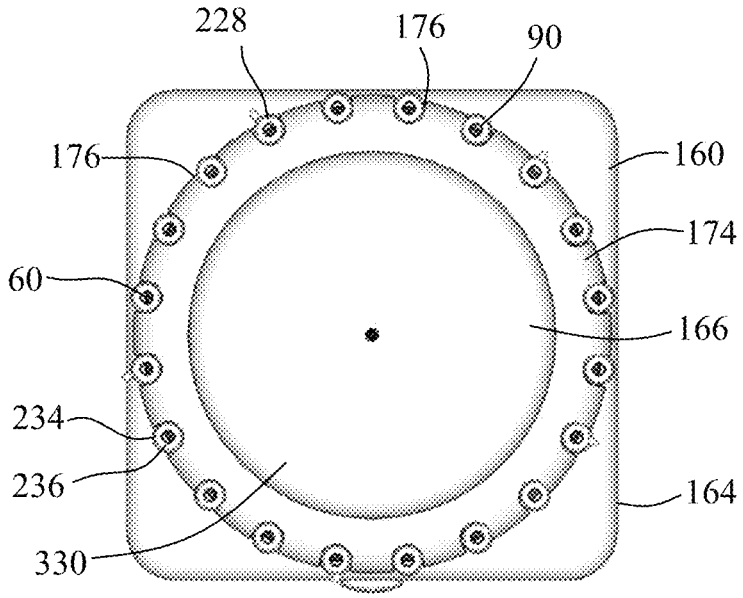
FIG. 34 is a bottom view of FIG. 32.
Figure 35:
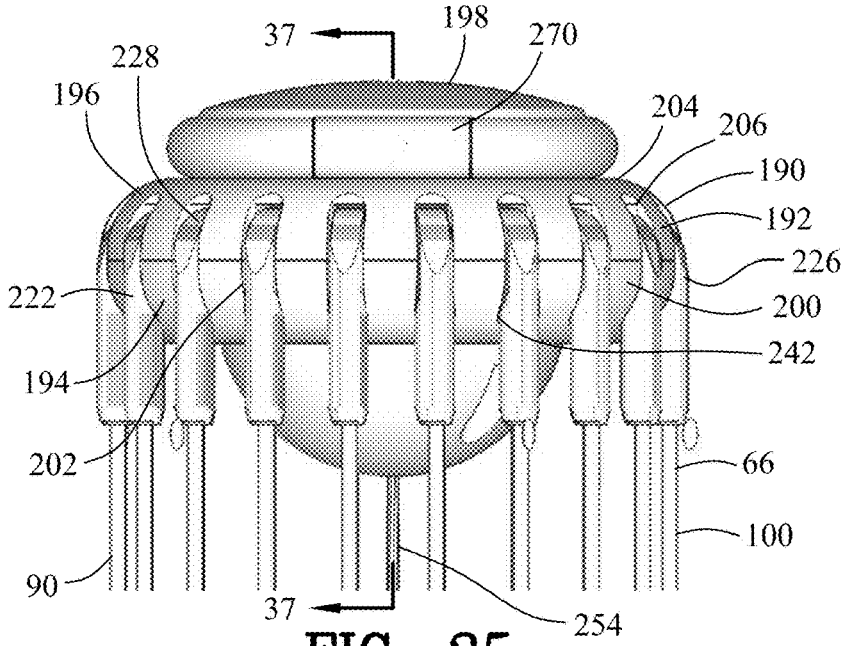
FIG. 35 is an enlarged portion of FIG. 32 illustrating an upper base.
Figure 36:
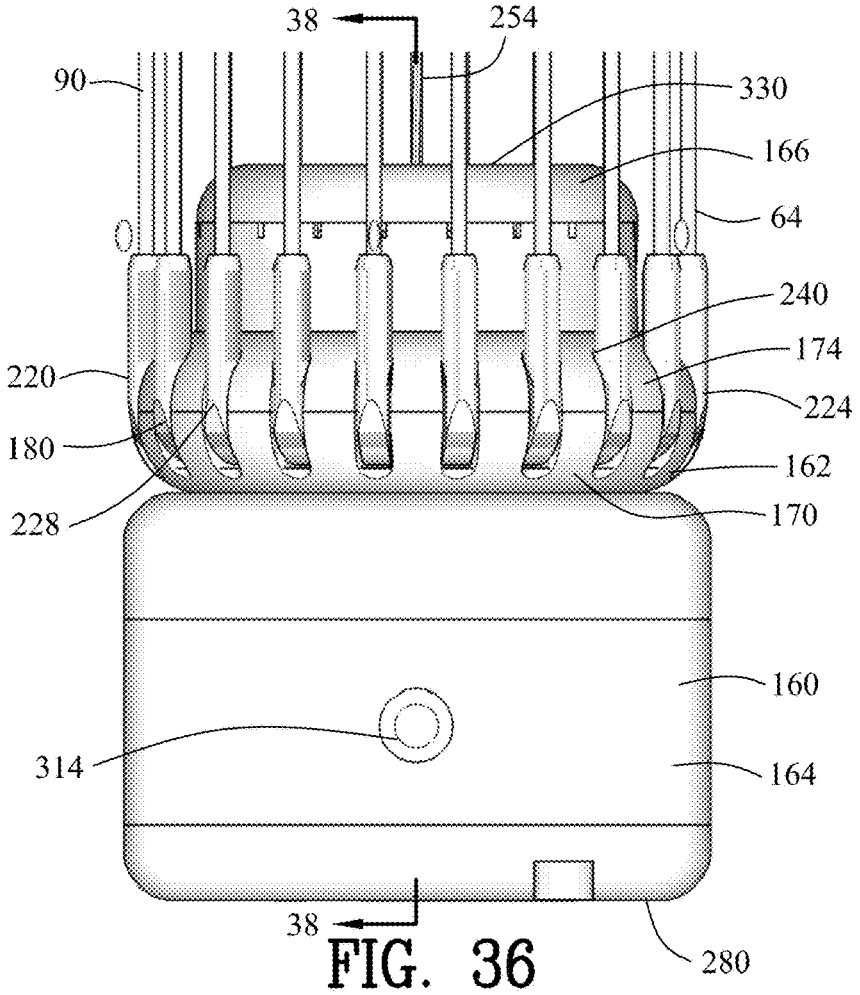
FIG. 36 is an enlarged portion of FIG. 32 illustrating a lower base.
Figure 37:
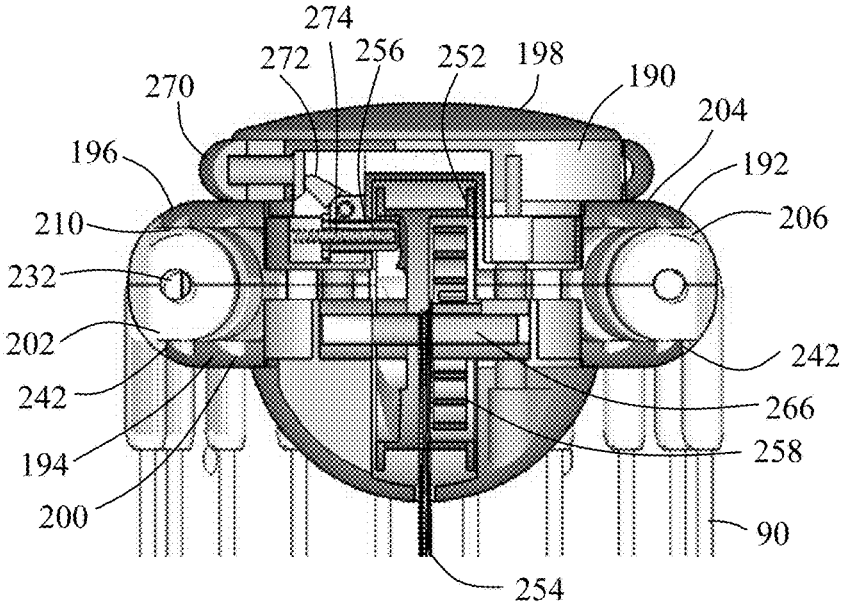
FIG. 37 is a sectional view along line 37-37 in FIG. 35.
Figure 38:
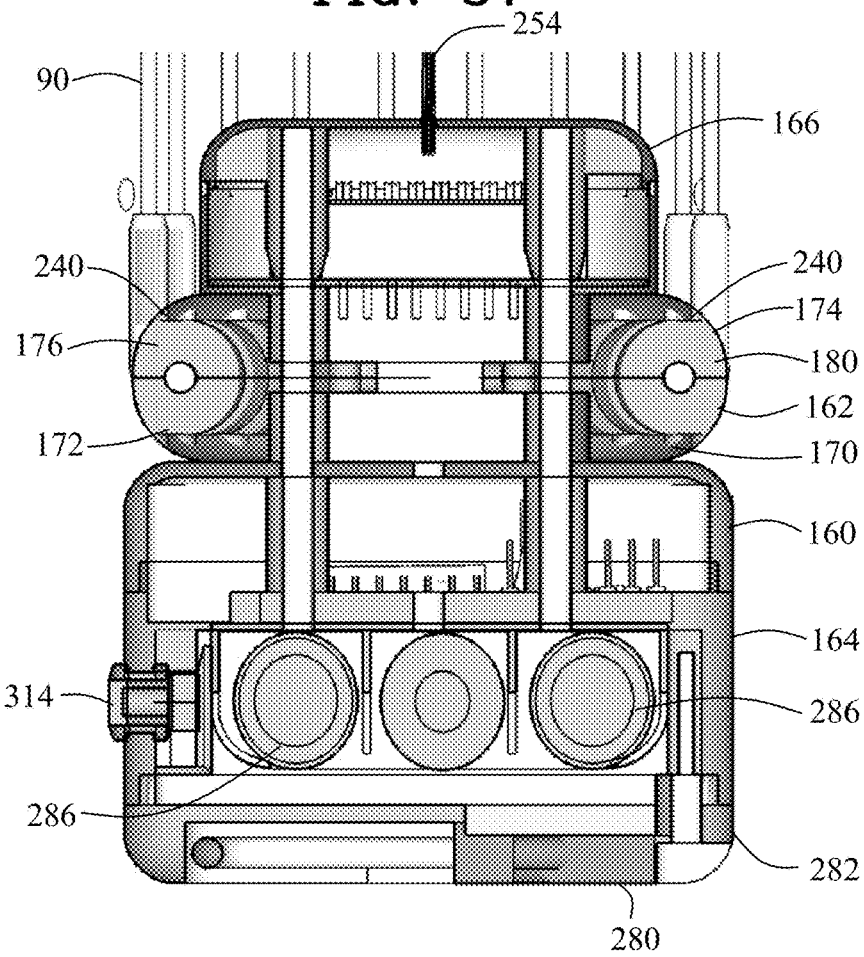
FIG. 38 is a sectional view along line 38-38 in FIG. 36.
Figure 39:
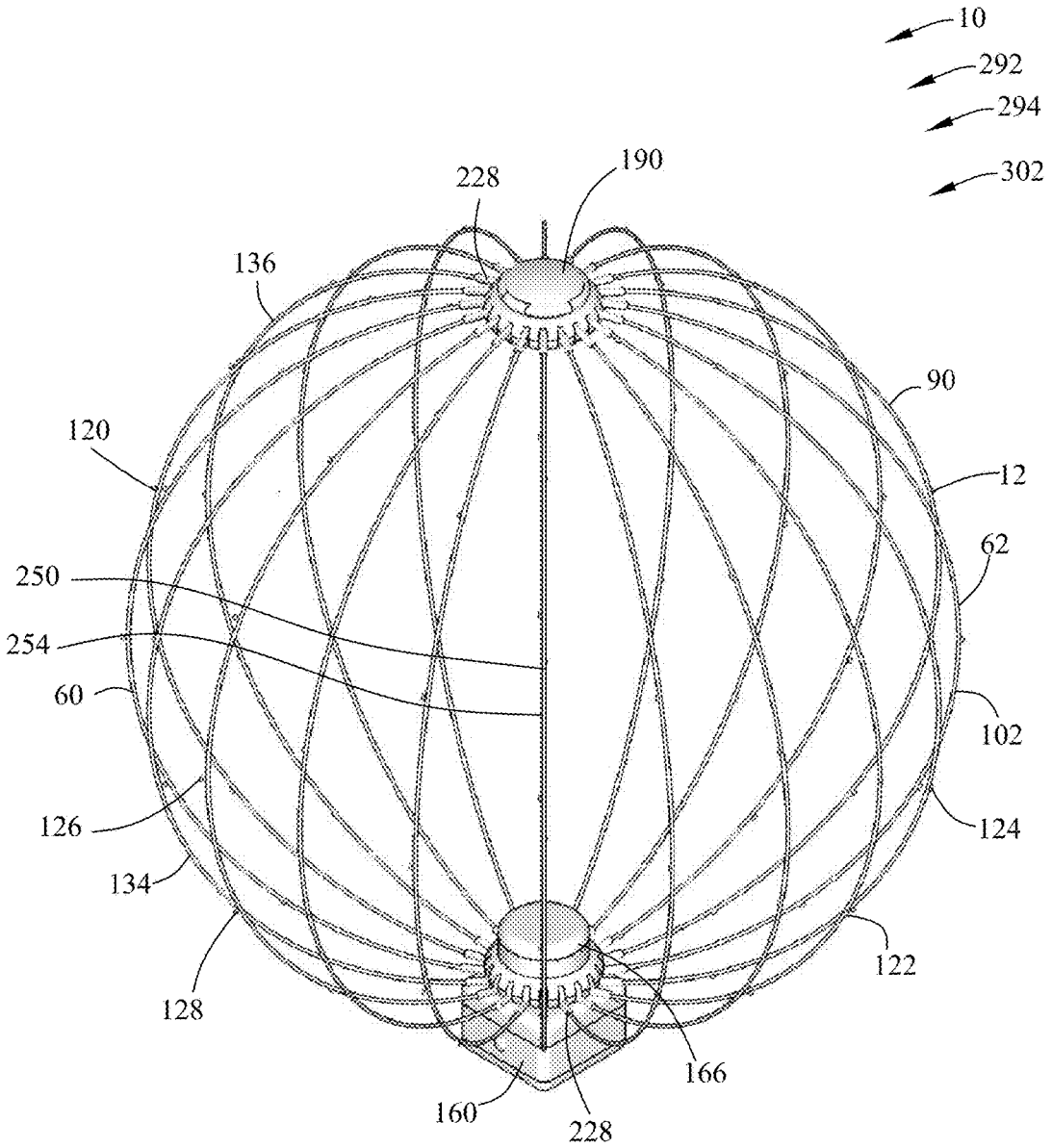
FIG. 39 is a view similar to FIG. 31 illustrating the illuminating device in a general globe body configuration.
Figure 40:
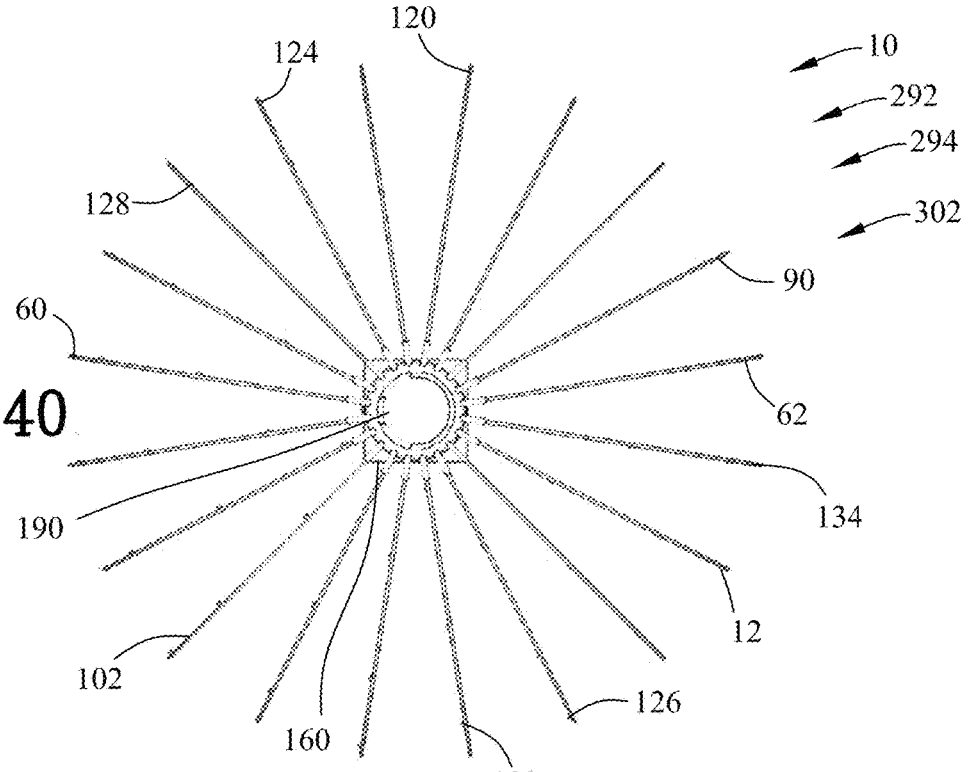
FIG. 40 is a top view of FIG. 39.
Figure 41:
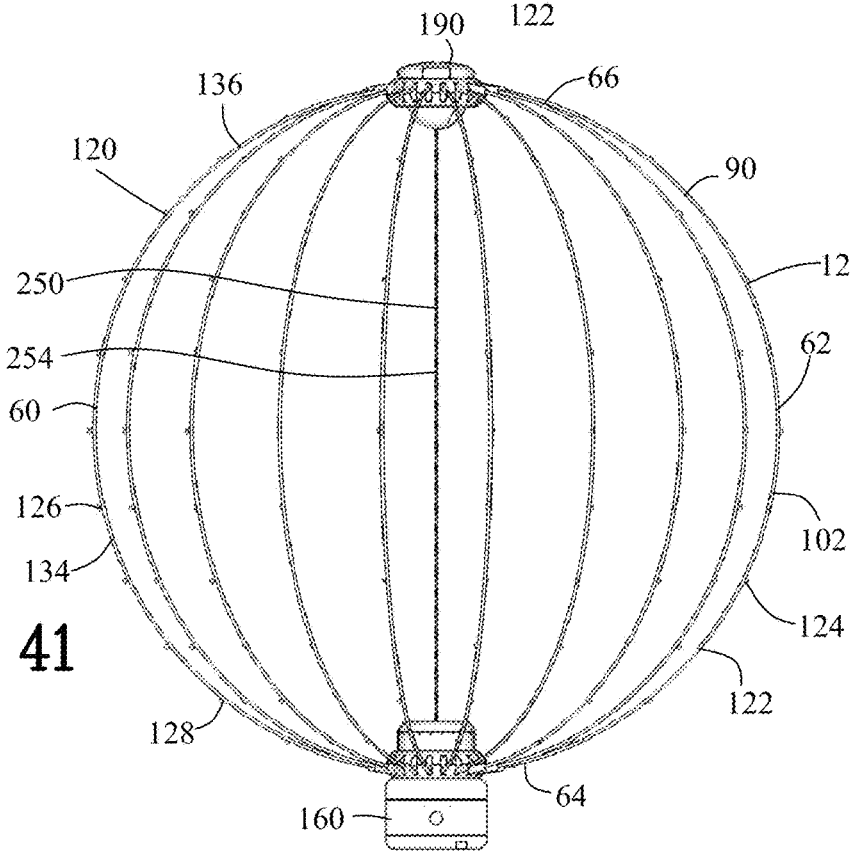
FIG. 41 is a front view of FIG. 39.
Figure 42:
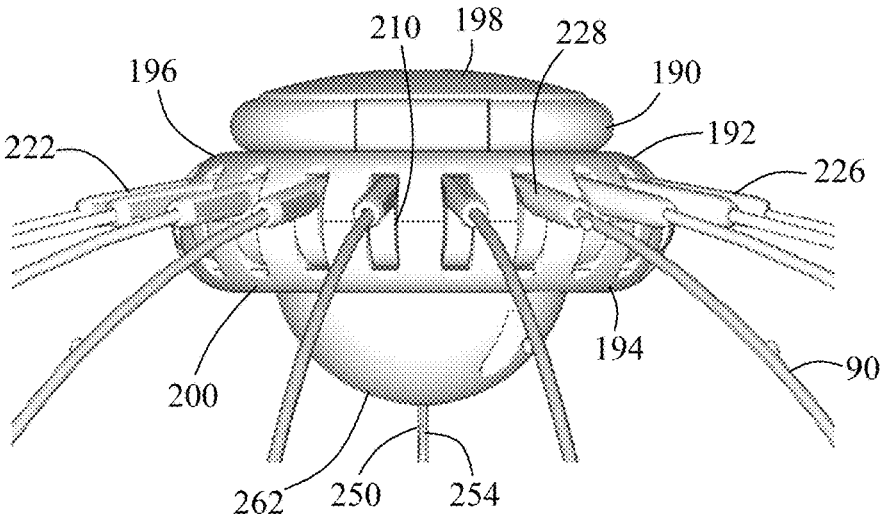
FIG. 42 is an enlarged portion of FIG. 41 illustrating the upper base.
Figure 43:
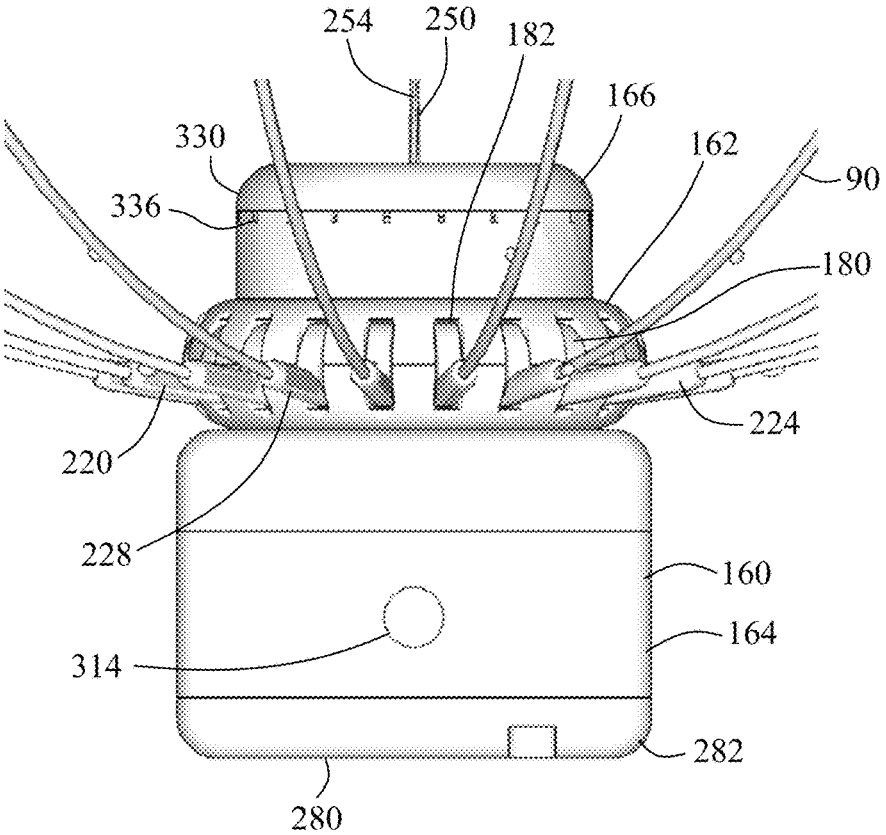
FIG. 43 is an enlarged portion of FIG. 41 illustrating the lower base.
Figure 44:
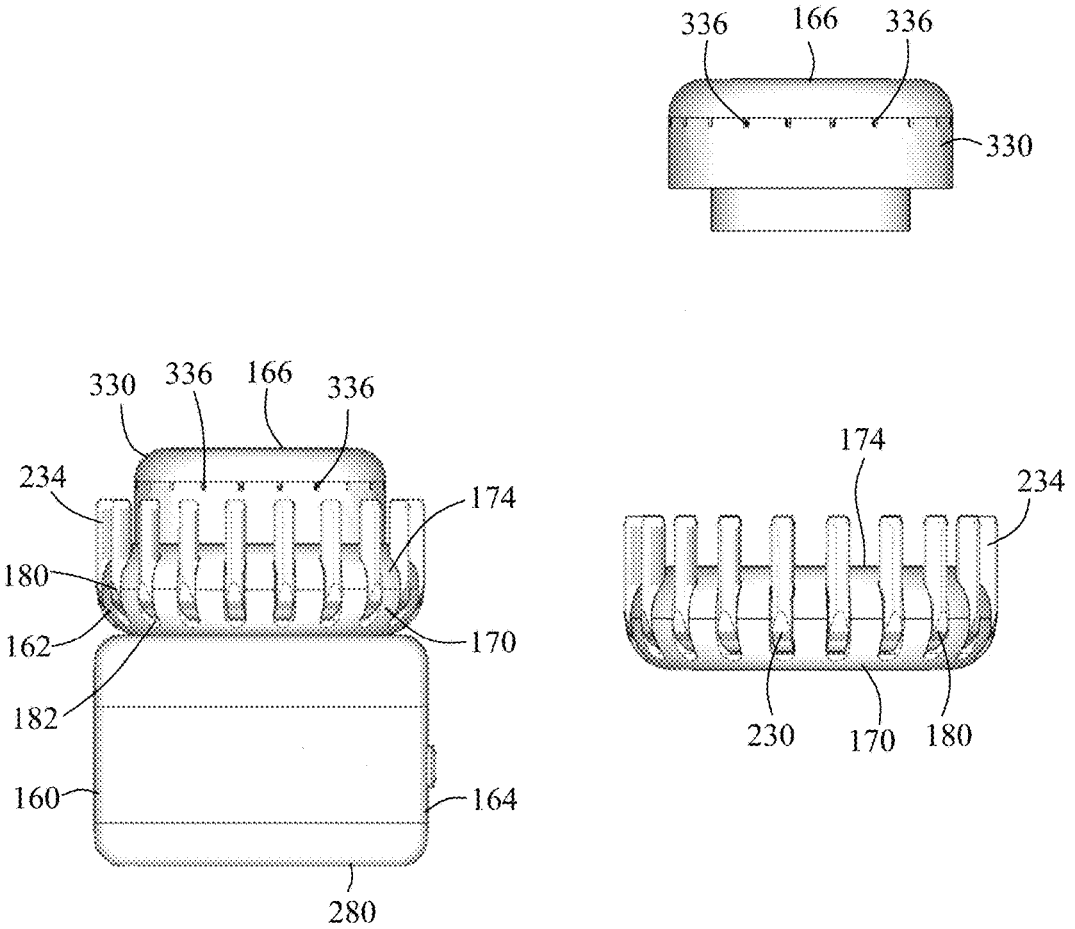
FIG. 44 is an enlarged view of FIG. 32 illustrating the lower base.
Figure 45:
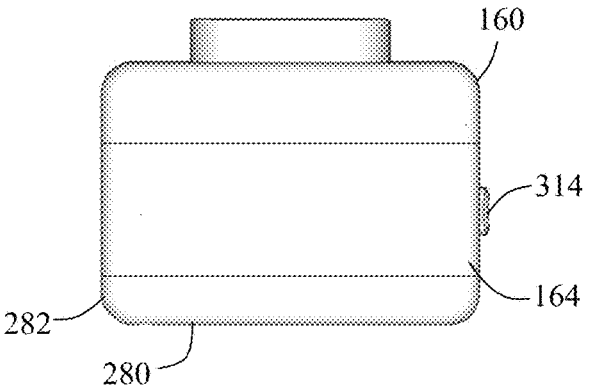
FIG. 45 is a partial exploded view of FIG. 44.
Figure 46:
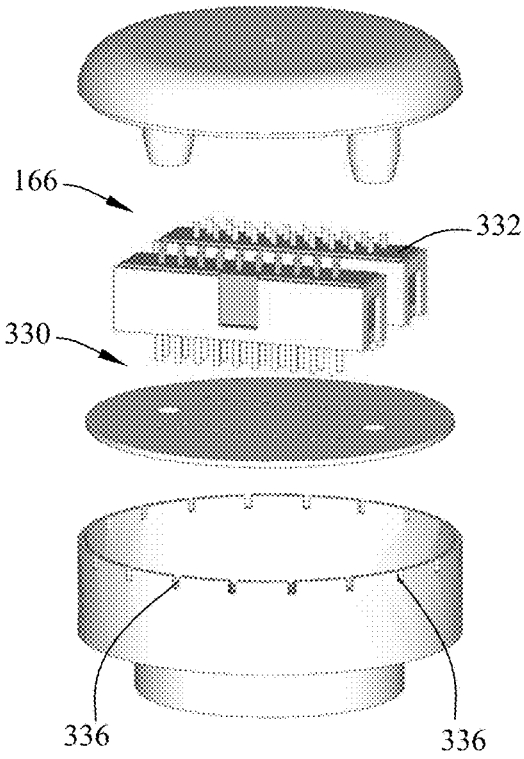
FIG. 46 is a secondary exploded view of FIG. 45.
Figure 48:
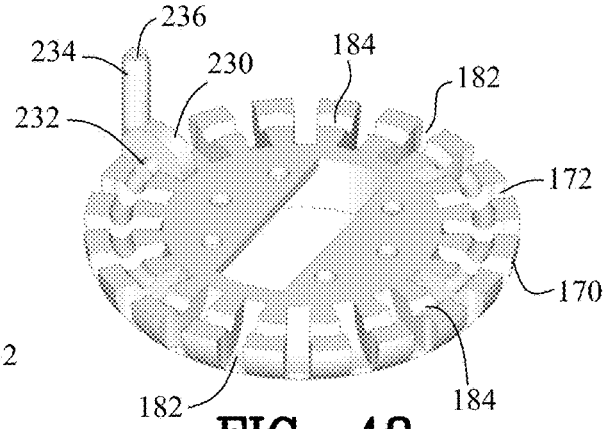
FIG. 48 is a front upper isometric view of a portion of FIG. 47.
Figure 47:
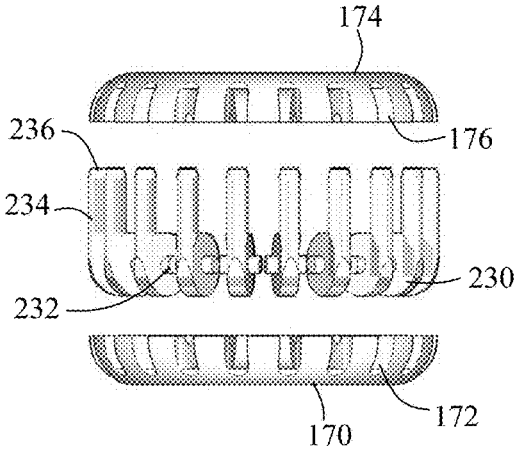
FIG. 47 is a secondary exploded view of FIG. 45.
Figure 49:
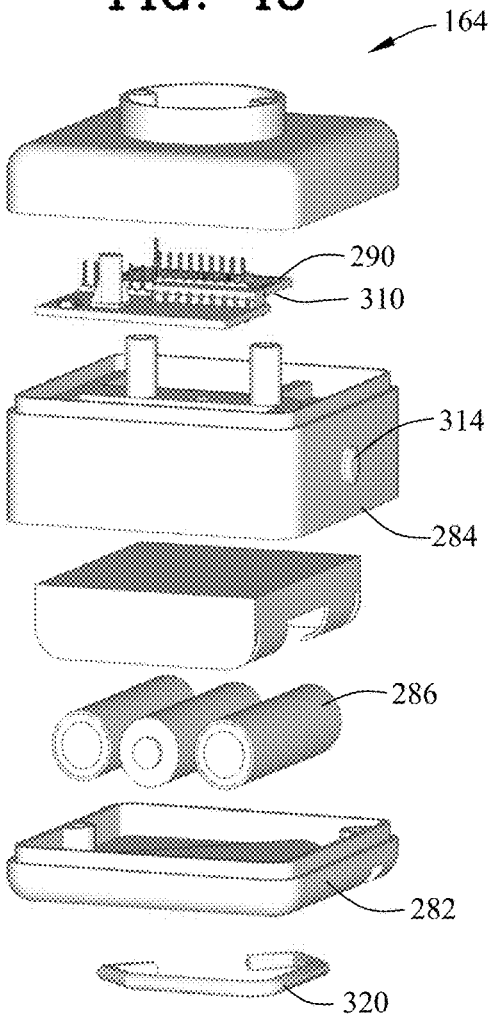
FIG. 49 is a secondary exploded view of FIG. 45.
Figure 50:
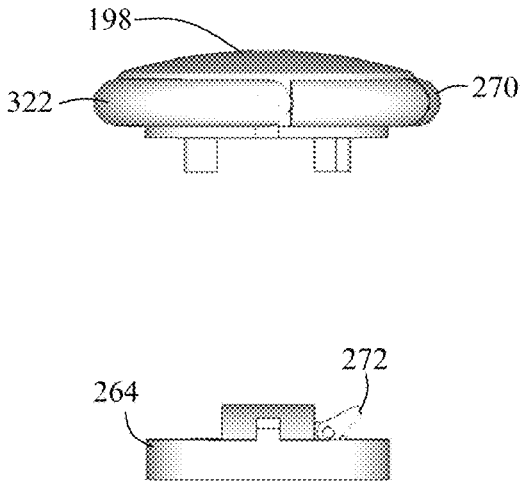
FIG. 50 is an enlarged view of FIG. 32 illustrating the upper base.
Figure 50:
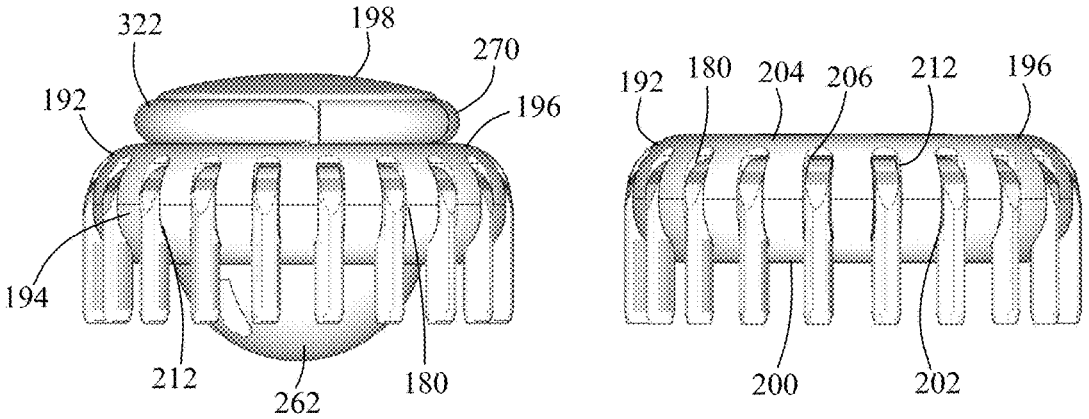
Figure 51:
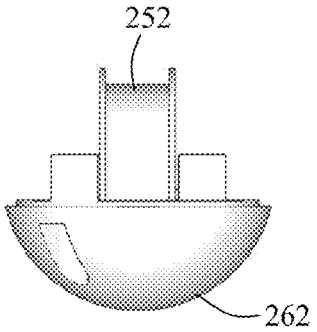
FIG. 51 is a partial exploded view of FIG. 50.
Figure 52:
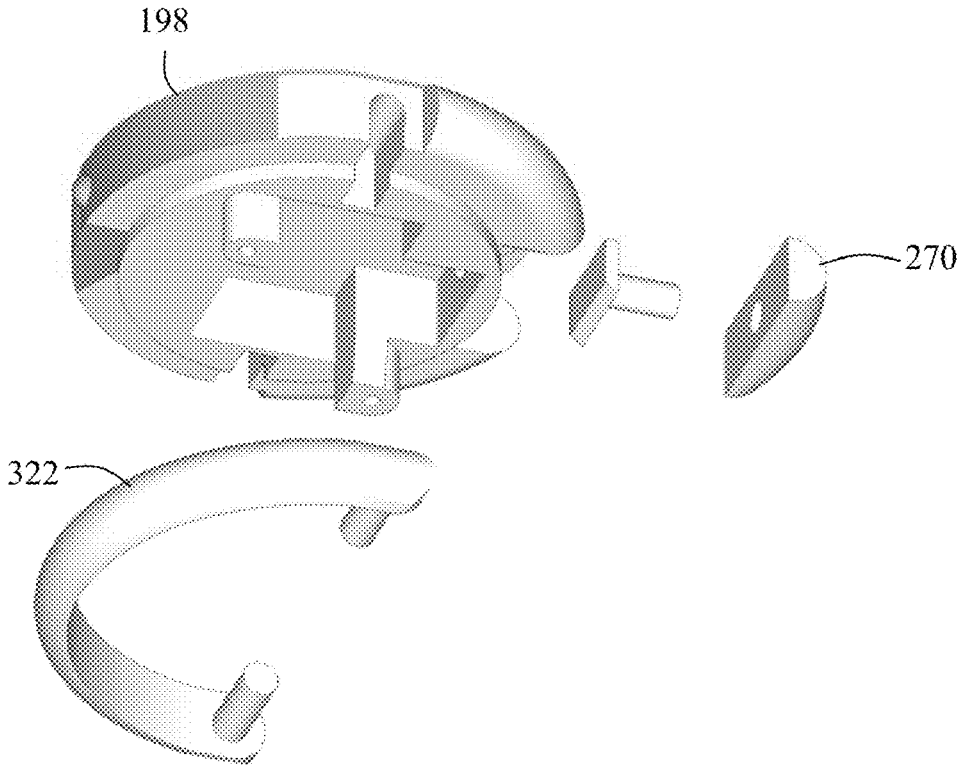
FIG. 52 is a secondary exploded view of FIG. 51.
Figure 53:
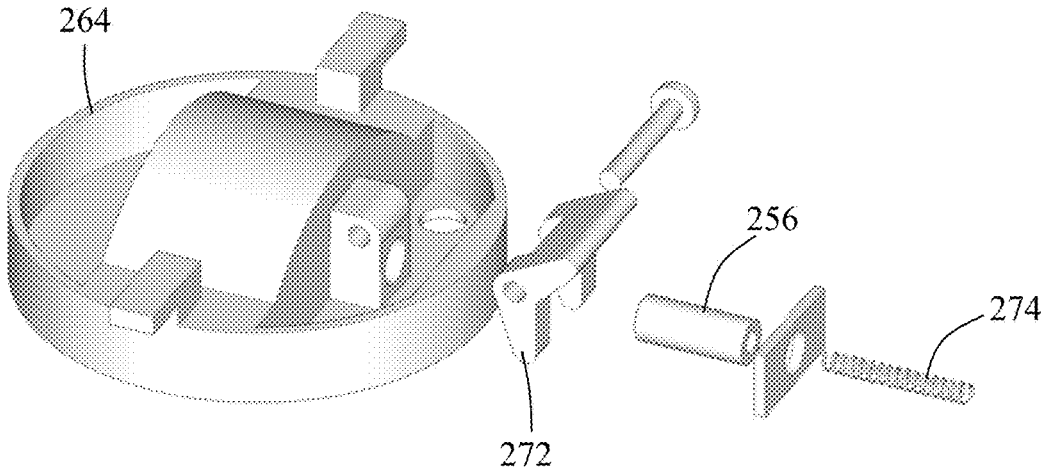
FIG. 53 is a secondary exploded view of FIG. 51.
Figure 54:
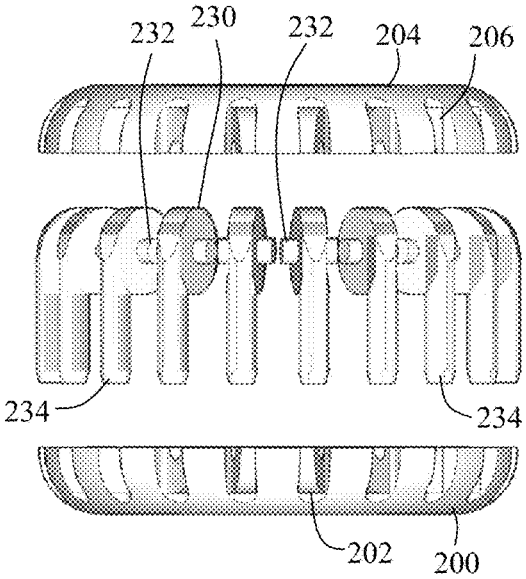
FIG. 54 is a secondary exploded view of FIG. 51
Figure 55:
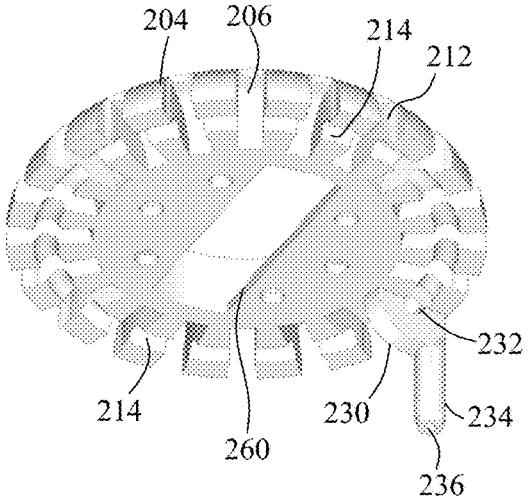
FIG. 55 is a front lower isometric view of a portion of FIG. 54.

As shown in FIGS. 16 and 17 the electrical circuit 290 may include a wireless receiver 310. A wireless transmitter 312 transmits a wireless signal to the wireless receiver 310 for controlling the plurality of illuminating devices 128. In addition, an electrical switch 314 may be depressed for controlling the plurality of illuminating devices 128.

A lower hanger hook 320 may be pivotably coupled to the lower base 20 and 160 for suspending the illuminating device 10 in an inverted position from an object. In addition, an upper hanger hook 322 may be pivotably coupled to the upper base 40 and 190 for suspending the illuminating device 10 in an upright position from an object.

The second embodiment for the illuminating device 10 in FIGS. 31-56 may include a wire management box 330 positioned above the lower base 160. The wire management box 330 contains a printed circuit board 332 receiving a plurality of wires 334. The plurality of wires 334 traverse a plurality of wire apertures 336 in the wire management box 330, along the plurality of rods 90 to the plurality of illuminating devices 128. The printed circuit board 332 is electrically coupled to the electrical circuit 290.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An illuminating device, comprising:

a lower base having a plurality of lower pivot receivers;

an upper base having a plurality of upper pivot receivers;

a first rod extending between a proximal end and a distal end;

a first lower pivot coupled to said proximal end of said first rod and engaging one of said lower pivot receivers;

a first upper pivot coupled to said distal end of said first rod and engaging one of said upper pivot receivers;

a second rod extending between a proximal end and a distal end;

a second lower pivot coupled to said proximal end of said second rod and engaging one of said lower pivot receivers;

a second upper pivot coupled to said distal end of said second rod and engaging one of said upper pivot receivers;

said first rod and said second rod converting between a general linear configuration and a general arcuate configuration upon converging said lower base with said upper base;

said first rod and said second rod converting between said general arcuate configuration and said general linear configuration upon diverging said lower base with said upper base;

a lock extending between said lower base and said upper base for terminating displacement of said lower base relative to said upper base;

a first illuminating device coupled to said first rod;

a second illuminating device couple to said second rod;

a first stopping arm extending from said first upper pivot;

a second stopping arm extending from said second upper pivot;

and said first stopping arm and said second stopping arm engaging with said upper base for terminating pivoting of said first upper pivot and said second upper pivot respectively in said general linear configuration for assuring said first rod and said second rod are displaced to the exterior of said lower base and said upper base upon converging said lower base with said upper base.

2. The illuminating device as set forth in claim 1, wherein said first illuminating device including a first plurality of illuminating devices extending between said proximal end and said distal end of said first rod; and said second illuminating device including a second plurality of illuminating devices extending between said proximal end and said distal end of said second rod.

3. The illuminating device as set forth in claim 1, further including a plurality of rods extending between a proximal end and a distal end;

a plurality of lower pivots coupled to said proximal end of said plurality of rods and engaging said lower pivot receivers;

a plurality of upper pivots coupled to said distal end of said plurality of rods and engaging said upper pivot receivers;

said plurality of rods defining a general cylindrical body in said linear configuration; and said plurality of rods defining a general globe body in said arcuate configuration.

4. The illuminating device as set forth in claim 1, wherein said lower base includes a replaceable electrical power source.

5. The illuminating device as set forth in claim 1, wherein said lower base includes an electrical circuit coupled to said first illuminating device and said second illuminating device for selectively activating and deactivating said first illuminating device and said second illuminating device for creating an illuminating pattern.

6. The illuminating device as set forth in claim 3, wherein said lower base includes an electrical circuit coupled to said first illuminating device and said second illuminating device for selectively activating and deactivating said first illuminating device and said second illuminating device for creating a cylindrical illuminating pattern in said general cylindrical body and a global illuminating pattern in said general globe body.

7. The illuminating device as set forth in claim 5, wherein said electrical circuit includes a wireless receiver; and a wireless transmitter transmitting a wireless signal to said wireless receiver for controlling said first illuminating device and said second illuminating device.

8. The illuminating device as set forth in claim 1, further including a hanger couple to said upper base for hanging the illuminating device.

9. The illuminating device as set forth in claim 1, wherein said lock includes a primary tube coupled to said lower base and a secondary tube coupled to said upper base for slidably engaging and defining a telescoping elongated member;

a clip pivotably couple to said telescoping elongated member;

said clip engaging said telescoping elongated member for terminating displacement of said primary tube relative to said secondary tube; and said clip disengaging said telescoping elongated member for permitting displacement of said primary tube relative to said secondary tube.

10. The illuminating device as set forth in claim 1, wherein said lock includes a wheel rotatably coupled to said upper base;

a tether encircling said wheel and coupled to said lower base;

a wheel pin slidably engaging said upper base and engaging said wheel for terminating rotation of said wheel or disengaging said wheel for permitting rotation of said wheel; and a spiral spring engaging said wheel for rotating said wheel and winding said tether about said wheel upon said wheel pin disengaged with said wheel and said lower base converging with said upper base.

11. A illuminating device, comprising:

a lower base having a plurality of lower pivot receivers;

an upper base having a plurality of upper pivot receivers;

a plurality of rods extending between a proximal end and a distal end;

a plurality of lower pivots coupled to said proximal end of said plurality of rods and engaging said plurality of lower pivot receivers;

a plurality of upper pivots coupled to said distal end of said plurality of rods and engaging said plurality of upper pivot receivers;

said plurality of rods converting between a general linear configuration and a general arcuate configuration upon converging said lower base with said upper base;

said plurality of rods converting between said general arcuate configuration and said general linear configuration upon diverging said lower base with said upper base;

a lock extending between said lower base and said upper base for terminating displacement of said lower base relative to said upper base;

an illuminating device coupled to said plurality of rods;

a plurality of stopping arms extending from said plurality of upper pivots; and said plurality of stopping arms engaging with said upper base for terminating pivoting of said plurality of upper pivots in said general linear configuration for assuring said plurality of rods are displaced to the exterior of said lower base and said upper base upon converging said lower base with said upper base.

12. The illuminating device as set forth in claim 11, wherein said illuminating device including a plurality of illuminating devices extending between said proximal end and said distal end of said first rod;

said plurality of rods defining a general cylindrical body in said linear configuration;

said plurality of rods defining a general globe body in said arcuate configuration;

said plurality of illuminating devices defining a general illuminated cylindrical body in said linear configuration; and said plurality of illuminating devices defining a general illuminated globe body in said arcuate configuration.

13. An illuminating device, comprising:

a lower base having a plurality of lower pivot receivers;

an upper base having a plurality of upper pivot receivers;

a first rod extending between a proximal end and a distal end;

a first lower pivot coupled to said proximal end of said first rod and engaging one of said lower pivot receivers;

a first upper pivot coupled to said distal end of said first rod and engaging one of said upper pivot receivers;

a second rod extending between a proximal end and a distal end;

a second lower pivot coupled to said proximal end of said second rod and engaging one of said lower pivot receivers;

a second upper pivot coupled to said distal end of said second rod and engaging one of said upper pivot receivers;

said first rod and said second rod converting between a general linear configuration and a general arcuate configuration upon converging said lower base with said upper base;

said first rod and said second rod converting between said general arcuate configuration and said general linear configuration upon diverging said lower base with said upper base;

a lock extending between said lower base and said upper base for terminating displacement of said lower base relative to said upper base;

a first illuminating device coupled to said first rod;

a second illuminating device couple to said second rod;

a first upper stopping surface in said upper base;

a second upper stopping surface in upper base;

said first upper pivot and said second upper pivot engaging with said first upper stopping surface and said second upper stopping surface for terminating pivoting of said first upper pivot and said second upper pivot respectively in said general linear configuration for assuring said first rod and said second rod are displaced to the exterior of said lower base and said upper base upon converging said lower base with said upper base.

14. An illuminating device, comprising:

a lower base having a plurality of lower pivot receivers;

an upper base having a plurality of upper pivot receivers;

a first rod extending between a proximal end and a distal end;

a first lower pivot coupled to said proximal end of said first rod and engaging one of said lower pivot receivers;

a first upper pivot coupled to said distal end of said first rod and engaging one of said upper pivot receivers;

a second rod extending between a proximal end and a distal end;

a second lower pivot coupled to said proximal end of said second rod and engaging one of said lower pivot receivers;

a second upper pivot coupled to said distal end of said second rod and engaging one of said upper pivot receivers;

said first rod and said second rod converting between a general linear configuration and a general arcuate configuration upon converging said lower base with said upper base;

said first rod and said second rod converting between said general arcuate configuration and said general linear configuration upon diverging said lower base with said upper base;

a lock extending between said lower base and said upper base for terminating displacement of said lower base relative to said upper base;

a first illuminating device coupled to said first rod;

a second illuminating device couple to said second rod;

a first lower stopping surface in said lower base;

a second lower stopping surface in lower base; and said first lower pivot and said second lower pivot engaging with said first lower stopping surface and said second lower stopping surface for terminating pivoting of said first lower pivot and said second lower pivot respectively in said general linear configuration for assuring said first rod and said second rod are displaced to the exterior of said lower base and said upper base upon converging said lower base with said upper base.

* * * * *